US008671894B2

(12) United States Patent
Kodama

(10) Patent No.: US 8,671,894 B2
(45) Date of Patent: Mar. 18, 2014

(54) VARIABLE COMPRESSION RATIO INTERNAL ENGINE

(75) Inventor: Kohei Kodama, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 254 days.

(21) Appl. No.: 13/375,106

(22) PCT Filed: Jun. 19, 2009

(86) PCT No.: PCT/JP2009/061667

§ 371 (c)(1),
(2), (4) Date: Nov. 29, 2011

(87) PCT Pub. No.: WO2010/146721

PCT Pub. Date: Dec. 23, 2010

(65) Prior Publication Data

US 2012/0080012 A1 Apr. 5, 2012

(51) Int. Cl.
*F02B 75/04* (2006.01)

(52) U.S. Cl.
USPC ..... 123/48 C; 123/78 C

(58) Field of Classification Search
USPC ..... 123/48 R, 48 B, 48 C, 78 R, 78 C, 78 F
See application file for complete search history.

(56) References Cited

U.S. PATENT DOCUMENTS

| | | | |
|---|---|---|---|
| 5,143,033 | A | 9/1992 | Catterson et al. |
| 6,276,324 | B1 | 8/2001 | Adams et al. |

FOREIGN PATENT DOCUMENTS

| | | | |
|---|---|---|---|
| CA | 2 303 736 | C | 2/2005 |
| EP | 0 509 738 | A1 | 10/1992 |
| EP | 1 043 481 | A1 | 10/2000 |
| JP | U-63-141806 | | 9/1988 |
| JP | A-06-058198 | | 3/1994 |
| JP | A-06-101421 | | 4/1994 |
| JP | A-2000-230607 | | 8/2000 |
| JP | A-2005-325702 | | 11/2005 |
| JP | A-2007-332798 | | 12/2007 |
| JP | A-2008-075602 | | 4/2008 |
| JP | A-2009-097449 | | 5/2009 |
| WO | WO 2008/035200 | A2 | 3/2008 |

OTHER PUBLICATIONS

International Search Report issued in Application No. PCT/JP2009/061667; Dated Jul. 28, 2009 (With Translation).

*Primary Examiner* — Noah Kamen
(74) *Attorney, Agent, or Firm* — Oliff PLC

(57) ABSTRACT

A variable compression ratio internal engine including at least two block portions connected to each other and moveable relative to each other so that the compression ratio can be varied. The engine includes an input gear for inputting a rotation output from an output gear to the cam shaft. The input gear and a rotation transmission shaft are constituted to be able to slide relative to each other or the output gear and the rotation transmission shaft are constituted to be able to slide relative to each other in the direction of the movement of the one block portion relative to the other block portion such that the meshing between the input gear and the cam shaft side gear or the meshing between the output gear and the crank shaft side gear is maintained when the one block portion is moved relative to the other block portion.

20 Claims, 12 Drawing Sheets

(B)

(A)

VARIABLE COMPRESSION RATIO INTERNAL ENGINE

TECHNICAL FIELD

The present invention relates to a variable compression ratio internal engine.

BACKGROUND ART

A variable compression ratio internal engine wherein mechanical compression ratio in combustion chambers can be varied, is disclosed in the Unexamined Japanese Patent Publication No. 2008-075602. The internal engine disclosed in the Unexamined Japanese Patent Publication No. 2008-075602 generally comprises a cylinder block, a cylinder head mounted on the upper portion of the cylinder block and a crank case mounted on the lower portion of the cylinder block. The cylinder block and the cylinder head are mounted on the crank case to be able to move relative to the crank case. The mechanical compression ratio in the combustion chambers are varied by moving the cylinder block and the cylinder head relative to the crank case.

DISCLOSURE OF THE INVENTION

The internal engine disclosed in the Unexamined Japanese Patent Publication No. 2008-075602 comprises a shaft (hereinafter, referred to as—intake valve cam shaft—) having cams for reciprocally moving intake valves, and a shaft (hereinafter, referred to as—exhaust valve cam shaft—) having cams for reciprocally moving exhaust valves. Gears (hereinafter, respectively referred to as—intake valve side gear—and—exhaust valve side gear—) are mounted on the intake and exhaust valve shafts. A gear is mounted on the crank shaft (hereinafter, the gear will be referred to as—crank shaft side gear—) and the crank shaft side gear is meshed with a gear (hereinafter, referred to as —transmission gear—). A chain belt is wound around the intake valve side gear, the exhaust valve side gear and the transmission gear. In the internal engine disclosed in the Unexamined Japanese Patent Publication No. 2008-075602, during the engine operation, the rotation of the crank shaft is transmitted from the crank shaft gear to the transmission gear and the rotation transmitted to the transmission gear is transmitted to the intake and exhaust valve side gears via the chain belt and thereby the intake and exhaust valve cam shafts are rotated and therefore the intake and exhaust valves are reciprocally moved.

As explained above, in the internal engine disclosed in the Unexamined Japanese Patent Publication No. 2008-075602, the mechanical compression ratio in the combustion chambers are varied by the movement of the cylinder block and the cylinder head relative to the crank case. The intake and exhaust valve cam shafts are mounted on the cylinder head and the crank shaft is mounted on the crank case. Accordingly, when the cylinder block and the cylinder head are moved relative to the crank case, the relative positional relationship between the intake valve cam shaft and the crank shaft is changed and the relative positional relationship between the exhaust valve cam shaft and the crank shaft is changed. On the other hand, when the cylinder block and the cylinder head are moved relative to the crank case, the transmission gear is moved relative to the crank case along with the movement of the intake and exhaust valve side gears relative to the crank case and thereby the relative positional relationship among the intake and exhaust valve side gears and the transmission gear is maintained. At this time, the transmission gear moves relative to the crank shaft gear in the radial direction of the crank shaft gear. That is, in the internal engine disclosed in the Unexamined Japanese Patent Publication No. 2008-075602, when the cylinder block and the cylinder head is moved relative to the crank case, the transmission gear is moved relative to the crank case meshing with the crank shaft gear along with the movement of the intake and exhaust valve side gears relative to the crank case.

As explained above, when the cylinder block and the cylinder head are moved relative to the crank case, the transmission gear is moved relative to the crank shaft gear in the radial direction of the crank shaft gear and the rotation phase of the transmission gear is varied by the movement of the transmission gear relative to the crank shaft gear in the radial direction of the crank shaft gear. Accordingly, the rotation phases of the intake and exhaust valve side gears are varied and as a result, the opening and closing timings of the intake and exhaust valves are varied.

In this regard, the internal engine of the Unexamined Japanese Patent Publication No. 2008-075602 comprises a mechanism (hereinafter, referred to as—valve opening-and-closing timing varying mechanism—) for varying opening and closing timings of the intake and exhaust valves, independently of the rotation phase of the transmission gear, and varying the opening and closing timings of the intake and exhaust valves by the valve opening-and-closing timing varying mechanism so as to compensate the change of the rotation phase of the transmission gear when the cylinder block and the cylinder head are moved relative to the crank case during the engine operation.

As explained above, in the internal engine of the Unexamined Japanese Patent Publication No. 2008-075602, it is necessary to varying the opening-and-closing timings of the intake and exhaust valves by the valve opening-and-closing timing varying mechanism every the cylinder block and the cylinder head are moved relative to the crank case in order to vary the mechanical compression ratio in the combustion chambers.

In this regard, the object of the present invention is to provide a variable compression ratio internal engine which can vary the mechanical compression ratio in the combustion chambers by moving the cylinder block and the cylinder head relative to the crank case without varying the opening and closing timings of the intake and exhaust valves when the cylinder block and the cylinder head are moved relative to the crank case. Further, the object of the present invention is to provide a variable compression ratio internal engine constituted by at least two block portions connected to each other so as to be able to move relative to each other, the engine can vary the mechanical compression ratio in the combustion chambers by moving one of the block portions relative to the other block portion without varying the opening and closing timings of the intake and exhaust valves when one of the block portion is moved relative to the other block portion.

Further, in the internal engine of the Unexamined Japanese Patent Publication No. 2008-075602, the distance between the central axes of the transmission and crank shaft gears is changed when the cylinder block and the cylinder head is moved relative to the crank case. When the distance between the central axes of the transmission and crank shaft gears, that is, the distance between the gears is changed, the backlash between the gear is changed and this change may cause the generation of the noise and the vibration.

In this regard, the another object of the present invention is to provide a variable compression ratio internal engine which can vary the mechanical compression ratio in the combustion chambers by moving the cylinder block and the cylinder head relative to the crank case without producing the cause of the noise and the vibration or at least with the small possibility to produce the cause of the noise and the vibration. In relation thereto, the object of the present invention is to provide a variable compression ratio internal engine constituted by at least two block portions connected to each other so as to be able to move relative to each other, the engine can vary the mechanical compression ratio in the combustion chambers by moving one of the block portions relative to the other block portion without producing the cause of the noise and the vibration or at least with the small possibility to produce the cause of the noise and the vibration.

According to the first invention, there is provided, a variable compression ratio internal engine constituted by at least two block portions connected to each other so as to be able to move relative to each other and constituted such that the mechanical compression ratio in the combustion chamber can be varied by moving one of the block portions relative to the other block portion, comprising:

a cam shaft having a cam for driving an intake or exhaust valve positioned on one of the block portions;

a crank shaft positioned on the other block portion;

an output gear for outputting the rotation of the crank shaft; and an input gear for inputting the rotation output from the output gear to the cam shaft;

the engine being constituted such that the input gear moves relative to the output gear along with the movement of the one block portion when the one block portion is moved relative to the other block portion, wherein the engine further comprises a rotation transmission shaft for transmitting the rotation output from the output gear to the input gear, wherein the rotation transmission shaft has a crank shaft side gear meshed with the output gear on one end thereof and a cam shaft side gear meshed with the input gear on the other end thereof, wherein the output gear and the crank shaft side gear are meshed with each other such that the rotation transmission shaft is rotated around the axis thereof by the rotation of the crank shaft and the cam shaft side gear and the input gear are meshed with each other such that the cam shaft is rotated around the axis thereof by the rotation of the rotation transmission shaft, and wherein the input gear and the rotation transmission shaft are constituted to be able to slide relative to each other or the output gear and the rotation transmission shaft are constituted to be able to slide relative to each other in the direction of the movement of the one block portion relative to the other block portion such that the meshing between the input gear and the cam shaft side gear or the meshing between the output gear and the crank shaft side gear is maintained when the one block portion is moved relative to the other block portion.

According to the first invention, the meshing between the input gear and the cam shaft side gear or the meshing between the output gear and the crank shaft side gear is maintained by the sliding of the input gear and the rotation transmission shaft relative to each other or by the sliding of the output gear and the rotation transmission shaft relative to each other in the direction of the movement of the one block portion relative to the other block portion when the one block portion is moved relative to the other block portion. By maintaining the meshing between the input gear and the cam shaft side gear or the meshing between the output gear and the crank shaft side gear, the relationship between the rotation phases of the crank and cam shafts is not changed and is constant before and after the one block portion is moved relative to the other block portion. Therefore, according to the first invention, even when the one block portion is moved relative to the other block portion, it is unnecessary to adjust the rotation phase of the cam shaft along with the movement of one of the block portions.

Further, according to the first invention, the meshing between the input gear and the cam shaft side gear or the meshing between the output gear and the crank shaft side gear is maintained by the sliding of the input gear and the rotation transmission shaft relative to each other or by the sliding of the output gear and the rotation transmission shaft relative to each other in the direction of the movement of the one block portion relative to the other block portion when the one block portion is moved relative to the other block portion. By maintaining the meshing between the input gear and the cam shaft side gear or meshing between the output gear and the crank shaft side gear, even when the one block portion is moved relative to the other block portion, the change of the backlash between the input gear and the cam shaft side gear or the change of the backlash between the output gear and the crank shaft side gear is prevented or restricted. That is, according to the first invention, even when the one block portion is moved relative to the other block portion, the change of the backlash which may cause the noise and the vibration is prevented or restricted and therefore the generation of the noise and the vibration due to the change of the backlash is prevented or restricted.

According to the second invention, in the first invention, the input gear and the cam shaft side gear are constituted to be able to slide relative to each other in the direction of the movement of the one block portion relative to the other block portion such that the meshing between the input gear and the cam shaft side gear is maintained when the one block portion is moved relative to the other block portion.

According to the second invention, the constitution that the input and cam shaft side gears slide relative to each other is employed as means for sliding the input gear and the rotation transmission shaft relative to each other. By employing the constitution that the input and cam shaft side gears slide relative to each other, the relationship between the rotation phases of the crank and cam shafts is maintained constant before and after the one block portion is moved relative to the other block portion without complexifying the constitution of the rotation transmission shaft.

According to the third invention, in the second invention, the cam shaft side gear is a spur gear.

According to the third invention, the spur gear is employed as the cam shaft side gear. By employing the constitution that the input and spur gears slide relative to each, the relationship between the rotation phases of the crank and cam shafts is maintained constant before and after the one block portion is moved relative to the other block portion without complexifying the constitution of the cam shaft side gear.

According to the fourth invention, in any of the second and third inventions, at least one of the input and cam shaft side gears is biased against the other thereof such that the input and cam shaft side gears are pressed toward each other.

According to the fourth invention, the input and cam shaft side gears which slide relative to each other when the one block portion is moved relative to the other block portion, are pressed toward each other. In the case that the input and cam shaft side gears are constituted to be able to slide relative to each other, the meshing between the input and cam shaft side gears may not be sufficiently maintained, depending on the relative positional relationship between the input and cam shaft side gears. On the other hand, as in the fourth invention, when the input and cam shaft side gears are constituted to be pressed toward each other, the meshing between the input and cam shaft side gears is sufficiently maintained, independently of the relative positional relationship between the input and cam shaft side gears. Therefore, even when the one block portion is moved relative to the other block portion, the change of the backlash between the input and cam shaft side gear is further sufficiently prevented or restricted. That is, according to the fourth invention, even when the one block portion is moved relative to the other block portion, the change of the backlash which may cause the noise and the vibration is further sufficiently prevented or restricted and therefore the generation of the noise and the vibration due to the change of the backlash is further sufficiently prevented or restricted.

According to the fifth invention, in any of the second to fourth inventions, the rotation transmission shaft is supported on the block portions by a support member/support members at the position near the cam shaft side gear as possible.

According to the fifth invention, the rotation transmission shaft is supported at the position near the cam shaft side gear as possible and therefore the distance between the position where the rotation transmission shaft is supported and the cam shaft side gear is short as possible. The distance between the position where the rotation transmission shaft is supported and the cam shaft side gear affects the meshing condition between the cam shaft side and input gears, the rotation transmission shaft is facilitated to vibrate around the position where it is supported as the distance becomes long and therefore the meshing condition between the cam shaft side and input gears becomes insufficient when the rotation transmission shaft vibrates. Further, the insufficient meshing condition between the cam shaft side and input gears may cause the noise and the vibration. According to the fifth invention, the distance between the position where the rotation transmission shaft is supported and the cam shaft side gear is short as possible and therefore it is difficult for the rotation transmission shaft to vibrate around the position where the rotation transmission shaft is supported and thus the meshing condition between the cam shaft side and input gears is sufficiently maintained. Therefore, the noise and the vibration due to the insufficient meshing condition between the cam shaft side and input gears is prevented or restricted.

According to the sixth invention, in any of the first to fifth inventions, the output and cam shaft side gears are constituted to be able to slide relative to each other in the direction of the movement of the one block portion relative to the other block portion such that the meshing between the output and crank shaft side gears is maintained when the one block portion is moved relative to the other block portion.

According to the sixth invention, the constitution that the output and crank shaft side gears slide relative to each other is employed as means for sliding the output gear and the rotation transmission shaft relative to each other. By employing the constitution that the output and crank shaft side gears slide relative to each other, the relationship between the rotation phases of the crank and cam shafts is maintained constant before and after the one block portion is moved relative to the other block portion without complexifying the constitution of the rotation transmission shaft.

According to the seventh invention, in the sixth invention, the crank shaft side gear is a spur gear.

According to the seventh invention, the spur gear is employed as the crank shaft side gear. By employing the constitution that the output gear and the spur gear slide relative to each other, the relationship between the rotation phases of the crank and cam shafts is maintained constant before and after the one block portion is moved relative to the other block portion without complexifying the constitution of the crank shaft side gear.

According to the eighth invention, in any of the sixth and seventh inventions, at least one of the output and crank shaft side gears is biased against the other thereof such that the output and crank shaft side gears are pressed toward each other.

According to the eighth invention, the output and crank shaft side gears which slide relative to each other when the one block portion is moved relative to the other block portion, are pressed toward each other. In the case that the output and crank shaft side gears are constituted to be able to slide relative to each other, the meshing between the output and crank shaft side gears may not be sufficiently maintained, depending on the relative positional relationship between the output and crank shaft side gears. On the other hand, as in the eighth invention, when the output and crank shaft side gears are constituted to be pressed toward each other, the meshing between the output and crank shaft side gears is sufficiently maintained, independently of the relative positional relationship between the output and crank shaft side gears. Therefore, even when the one block portion is moved relative to the other block portion, the change of the backlash between the output and crank shaft side gears is further sufficiently prevented or restricted. That is, according to the eighth invention, even when the one block portion is moved relative to the other block portion, the change of the backlash which may cause the noise and the vibration is further sufficiently prevented or restricted and therefore the generation of the noise and the vibration due to the change of the backlash is further sufficiently prevented or restricted.

According to the ninth invention, in any of the sixth to eighth inventions, the rotation transmission shaft is supported on the block portions by a support member/support members at the position near the crank shaft side gear as possible.

According to the ninth invention, the rotation transmission shaft is supported at the position near the crank shaft side gear as possible and therefore the distance between the position where the rotation transmission shaft is supported and the crank shaft side gear is short as possible. The distance between the position where the rotation transmission shaft is supported and the crank shaft side gear affects the meshing condition between the crank shaft side and output gears, the rotation transmission shaft is facilitated to vibrate around the position where it is supported as the distance becomes long and therefore the meshing condition between the crank shaft side and output gears becomes insufficient when the rotation transmission shaft vibrates. Further, the insufficient meshing condition between the crank shaft side and output gears may cause the noise and the vibration. According to the ninth invention, the distance between the position where the rotation transmission shaft is supported and the crank shaft side gear is short as possible and therefore it is difficult for the rotation transmission shaft to vibrate around the position where the rotation transmission shaft is supported and thus the meshing condition between the crank shaft side and output gears is sufficiently maintained. Therefore, the noise and the vibration due to the insufficient meshing condition between the crank shaft side and output gears is prevented or restricted.

According to the tenth invention, in any of the second to ninth inventions, the rotation transmission shaft is constituted by at least two shaft portions, and the shaft portions are connected to be able to slide relative to each other in the direction of the movement of the one block portion relative to the other block portion such that the meshing between the input and cam shaft side gears or the meshing between the output and crank shaft side gears is maintained when the one block portion is moved relative to the other block portion.

According to the tenth invention, the meshing between the input and cam shaft side gears or the meshing between the output and crank shaft side gears is maintained by the sliding of the shaft portions relative to each other in the direction of the movement of the one block portion relative to the other block portion and by the sliding of the input gear and the rotation transmission shaft relative to each other or the sliding of the output gear and the rotation transmission shaft relative to each other in the direction of the movement of the one block portion relative to the other block portion when the one block portion is moved relative to the other block portion. Therefore, the meshing between the input and cam shaft side gears or the meshing between the output and crank shaft side gears is further sufficiently maintained. Therefore, even when the one block portion is moved relative to the other block portion, the change of the backlash between the input and camshaft side gears or the change of the backlash between the output and crank shaft side gears is further sufficiently prevented or restricted. Therefore, the generation of the noise and the vibration due to the change of the backlash is further sufficiently prevented or restricted.

According to the eleventh invention, in the first invention, the rotation transmission shaft is constituted by at least two shaft portions, and the shaft portions are connected to be able to slide relative to each other in the direction of the movement of the one block portion relative to the other block portion such that the meshing between the input and cam shaft side gears or the meshing between the output and crank shaft side gears is maintained when the one block portion is moved relative to the other block portion.

According to the eleventh invention, the constitution that the shaft portions slide relative to each other is employed as means for sliding the input gear and the rotation transmission shaft relative to each other. By employing the constitution that the shaft portions slide relative to each other, the relationship between the rotation phases of the crank and cam shafts is maintained constant before and after the one block portion is moved relative to the other block portion without complexifying the constitution of the rotation transmission shaft.

According to the twelfth invention, in the eleventh invention, the cam shaft side or crank shaft side gear is a bevel gear.

According to the twelfth invention, the bevel gear is employed as the cam shaft side or crank shaft side gear. By employing the bevel gear as the cam shaft side or crank shaft side gear, the contact between the cam shaft side and input gears or the contact between the crank shaft side and output gears becomes line contact and therefore the backlash generated due to the meshing between the input and cam shaft side gears or the meshing between the output and crank shaft side gears, is small. Therefore, the insufficient meshing condition between the input and cam shaft side gears or the insufficient meshing condition between the output and crank shaft side gears is prevented or restricted and therefore the generation of the noise and the vibration due to the insufficient meshing condition is prevented or restricted.

According to the thirteenth invention, in any of the tenth to twelfth inventions, the shaft portions are telescopically overlapped and the telescopically overlapping parts are supported by a ball spline so as to be able to slide relative to each other.

According to the thirteenth invention, the ball spline is employed as means for slide the shaft portions relative to each other. Therefore, it is easy for the shaft portions to slide relative to each other along with the movement of the one block portion when the one block portion is moved relative to the other block portion. Therefore, the meshing between the input and cam shaft side gears or the meshing between the output and crank shaft side gears is further sufficiently maintained when the one block portion is moved relative to the other block portion. Therefore, even when the one block portion is moved relative to the other block portion, the change of the backlash between the input and cam shaft side gears or the change of the backlash between the output and crank shaft side gears is further sufficiently prevented or restricted. Therefore, the generation of the noise and the vibration due to the change of the backlash is further sufficiently prevented or restricted.

According to the fourteenth invention, in any of the tenth to thirteenth inventions, the rotation transmission shaft is supported on the block portions by a support member/support members at the position near the cam shaft side or crank shaft side gear as possible.

According to the fourteenth invention, the rotation transmission shaft is supported at the position near the cam shaft side or crank shaft side gear and therefore the distance between the position where the rotation transmission shaft is supported and the cam shaft side gear or the distance between the position where the rotation transmission shaft is supported and the crank shaft side gear is short as possible The distance between the position where the rotation transmission shaft is supported and the cam shaft side gear or the distance between the position where the rotation transmission shaft is supported and the crank shaft side gear affects the meshing condition between the cam shaft side and input gears or the meshing condition between the crank shaft side and output gears, the rotation transmission shaft is facilitated to vibrate around the position where it is supported as the distance becomes long and therefore the meshing condition between the cam shaft side and input gears or the meshing condition between the crank shaft side and output gears becomes insufficient when the rotation transmission shaft vibrates. Further, the insufficient meshing condition between the cam shaft side and input gears or the insufficient meshing condition between the crank shaft side and output gears may cause the noise and the vibration. According to the fourteenth invention, the distance between the position where the rotation transmission shaft is supported and the cam shaft side gear or the distance between the position where the rotation transmission shaft is supported and the crank shaft side gear is short as possible and therefore it is difficult for the rotation transmission shaft to vibrate around the position where the rotation transmission shaft is supported and thus the meshing condition between the cam shaft side and input gears or the meshing condition between the crank shaft side and output gears is sufficiently maintained. Therefore, the generation of the noise and the vibration due to the insufficient meshing condition between the cam shaft side and input gears or the insufficient meshing condition between the crank shaft side and output gears is prevented or restricted.

According to the fifteenth invention, in any of the tenth to thirteen inventions, each shaft portion is supported on the block portion on either positions of the telescopically overlapping part by the supporting members such that each shaft can rotate around the axis thereof.

According to the fifteenth invention, each shaft portion is supported on the block portion by the support members. Therefore, the vibration of the shaft portions, that is, the vibration of the rotation transmission shaft is prevented or restricted and therefore the meshing condition between the cam shaft side and input gears or the meshing condition between the crank shaft side and output gears is sufficiently maintained. Therefore, the generation of the noise and the vibration due to the insufficient meshing condition between the cam shaft side and input gears or the insufficient meshing condition between the crank shaft side and output gears, is prevented or restricted.

According to the sixteenth invention, in any of the tenth to thirteenth inventions, the telescopically overlapping parts are supported by the support member(s) on the block portion such that the parts can rotate around the axis thereof.

According to the sixteenth invention, the shaft portions are supported on the block portion at the telescopically overlapping parts and therefore the backlash between the shaft portions is restricted to the minimum extent. Therefore, the shaft portions slide sufficiently relative to each other when the one block portion is moved relative to the other block portion. Therefore, the meshing between the input and cam shaft side gears or the meshing between the output and crank shaft side gears is further sufficiently maintained. Therefore, the generation of the noise and the vibration due to the insufficient meshing condition between the cam shaft side and input gears or the insufficient meshing condition between the crank shaft side and output gears, is prevented or restricted.

According to the seventeenth invention, in the sixteenth invention, the telescopically overlapping parts are supported by the support member(s) on the block portion at the position near the cam shaft side or crank shaft side gear as possible.

According to the seventeenth invention, the telescopically overlapping parts are supported at the position near the cam shaft side or crank shaft side gear as possible and therefore the distance between the position where the rotation transmission shaft is supported and the cam shaft side gear or the distance between the position where the rotation transmission shaft is supported and the crank shaft side gear is short as possible. The distance between the position where the rotation transmission shaft is supported and the cam shaft side gear or the distance between the position where the rotation transmission shaft is supported and the crank shaft side gear affects the meshing condition between the cam shaft side and input gears or the meshing condition between the crank shaft side and output gears, the rotation transmission shaft is facilitated to vibrate around the position where it is supported as the distance becomes long and therefore the meshing condition between the cam shaft side and input gears or the meshing condition between the crank shaft side and output gears becomes insufficient when the rotation transmission shaft vibrates. Further, the insufficient meshing condition between the cam shaft side and input gears or the insufficient meshing condition between the crank shaft side and output gears may cause the noise and the vibration. According to the seventeenth invention, the distance between the position where the rotation transmission shaft is supported and the cam shaft side gear or the distance between the position where the rotation transmission shaft is supported and the crank shaft side gear is short as possible and therefore it is difficult for the rotation transmission shaft to vibrate around the position where the rotation transmission shaft is supported and thus the meshing condition between the cam shaft side and input gears or the meshing condition between the crank shaft side and output gears is sufficiently maintained. Therefore, the generation of the noise and the vibration due to the insufficient meshing condition between the cam shaft side and input gears or the insufficient meshing condition between the crank shaft side and output gears is prevented or restricted.

BRIEF DESCRIPTION OF THE DRAWINGS

FIG. 2(A) is a longitudinal sectional view of the support member and FIG. 2(B) is a cross sectional view of the support member along the line B-B of FIG. 2(A).

FIG. 4(A) shows a state when the cylinder block and the cylinder head are positioned closest to the crank case and FIG. 4(B) shows a state when the cylinder block and the cylinder head are positioned remotest from the crank case.

FIG. 5 is a view similar to FIG. 3(A) and FIG. 5(A) shows a state when the cylinder block and the cylinder head are positioned closest to the crank case and FIG. 5(B) shows a state when the cylinder block and the cylinder head are positioned remotest from the crank case.

FIG. 8 is a view similar to FIG. 7(A) and FIG. 8(A) shows a state when the cylinder block and the cylinder head are positioned closest to the crank case and FIG. 7(B) shows a state when the cylinder block and the cylinder head are positioned remotest from the crank case.

FIG. 12 is a cross sectional view showing the rotation transmission shaft of the seventh embodiment and FIG. 12(A) shows a state when the cylinder block and the cylinder head are positioned closest to the crank case and FIG. 12(B) shows a state when the cylinder block and the cylinder head are positioned remotest from the crank case.

BEST MODE FOR CARRYING OUT THE INVENTION

Figure 1:
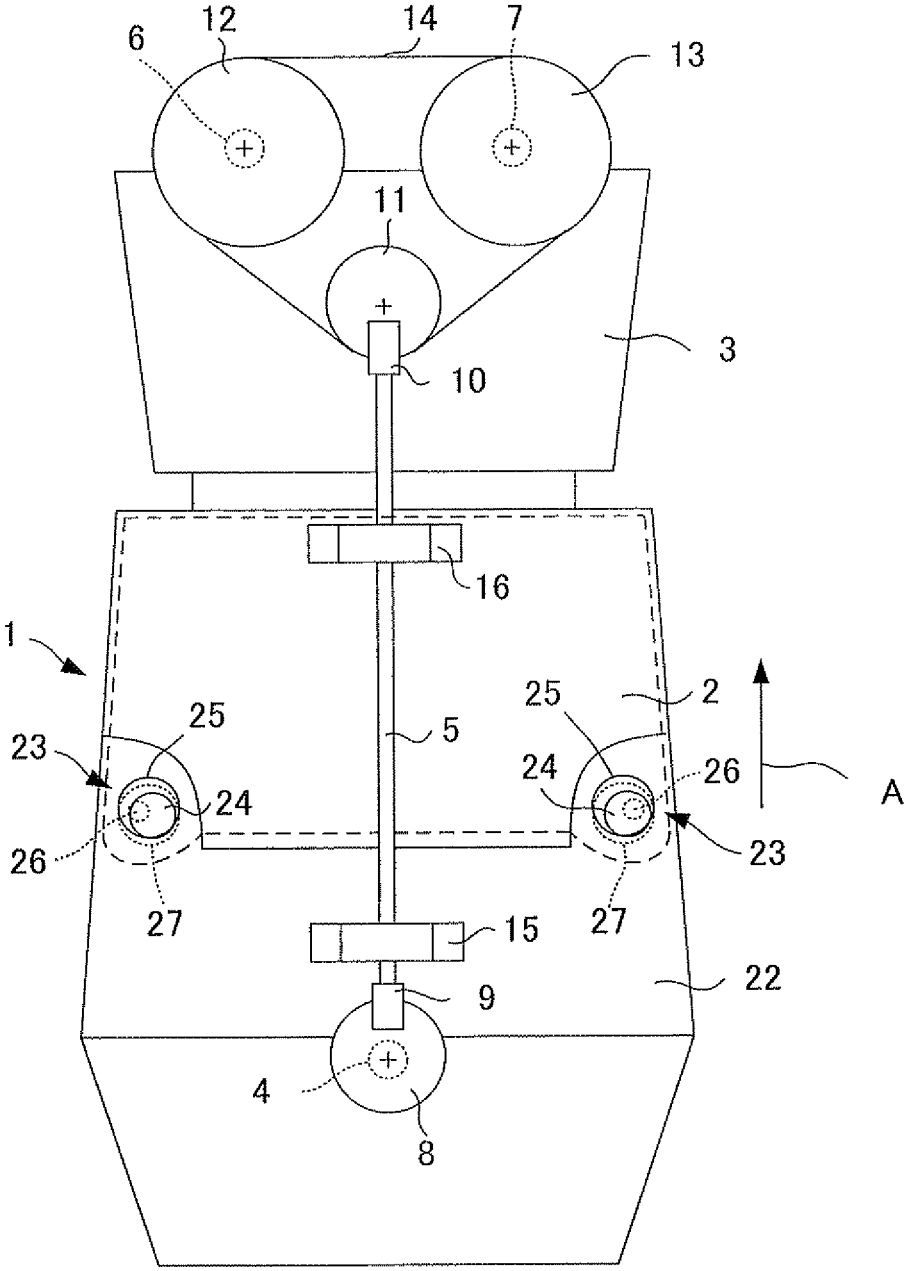
FIG. 1 is a view showing the entire of the variable compression ratio internal engine of the first embodiment of the invention.

Below, the embodiments of the invention will be explained, referring to the drawings. FIG. 1 shows an embodiment (hereinafter, referred to as—first embodiment—) of the variable compression ratio internal engine of the invention. In FIG. 1, 1 denotes an internal engine. The internal engine 1 comprises a cylinder block 2, a crank case 22, cylinder head 3, a crank shaft 4, a rotation transmission shaft 5, an intake valve cam shaft 6 and an exhaust valve cam shaft 7.

The cylinder head 3 is fixed on the upper portion of the cylinder block 2. The crank case 22 is mounted on the lower portion of the cylinder block 2. The cylinder block 2 is mounted on the crank case 22 such that the cylinder block 2 can move relative to the crank case 22 in the direction A of reciprocal movement of a piston (not shown) in a combustion chamber (not shown).

An eccentric shaft 23 is positioned between the cylinder block 2 and the crank case 22. The eccentric shaft 23 has a main shaft 24, a cylindrical cam 25 mounted on the main shaft 24 so as not to be able to rotate relative to the main shaft 24, a sub shaft 26 and a cylindrical cam mounted on the sub shaft 26 so as not to be able to rotate relative to the sub shaft 26. The cam 25 is mounted on the main shaft 24 such that the central axis of the cam 25 aligns with the central axis of the main shaft 24. On the other hand, the cam 27 is mounted on the sub shaft 26 such that the central axis of the cam 27 aligns with the central axis of the sub shaft 26. The central axes of the main and sub shafts 24 and 26 are offset relative to each other. The central axes of the cams 25 and 27 are offset relative to each other. The sub shaft 26 is inserted into the cylindrical cavity formed in the main shaft 24 so as to be able to rotate relative to the main shaft 24. The cam 25 mounted on the main shaft 24 is inserted into the cylindrical cavity formed in the cylinder block 2 so as to be able to rotate relative to the cylinder block 2. On the other hand, the cam 27 mounted on the sub shaft 26 is inserted into the cylindrical cavity formed in the crank case 22 so as to be able to rotate relative to the crank case 22.

As shown in FIG. 4(A), when the main shaft 24 is rotated in the direction indicated by the solid arrow in FIG. 4(A), the cam 25 mounted on the main shaft 24 is rotated in the same direction. At this time, the sub shaft 26 moves toward the body of the crank case 22 in the main shaft 24 along with the rotation of the main shaft 24. At this time, the cam 27 mounted on the sub shaft 26 is rotated in the direction indicated by the chain arrow in FIG. 4(A) along with the movement of the sub shaft 26. Thereby, the cylinder block 2 and the cylinder head 3 mounted on the upper portion of the cylinder block 2 are moved away from the crank case 22 in the direction of the reciprocal movement of the piston which moves reciprocally in the combustion chamber, that is, in the direction Au indicated by the arrow in FIG. 4(A). FIG. 4(B) shows the state that the cylinder block 2 and cylinder head 3 are moved remotest from the crank case 22.

On the other hand, as shown in FIG. 4(B), when the main shaft 24 is rotated in the direction indicated by the solid arrow in FIG. 4(B), the cam 25 mounted on the main shaft 24 is rotated in the same direction. At this time, the sub shaft 26 moves away from the body of the crank case 22 in the main shaft 24 along with the rotation of the main shaft 24. At this time, the cam 27 mounted on the sub shaft 26 is rotated in the direction indicated by the chain arrow in FIG. 4(B) along with the movement of the sub shaft 26. Thereby, the cylinder block 2 and the cylinder head 3 mounted on the upper portion of the cylinder block 2 are moved toward the crank case 22 in the direction of the reciprocal movement of the piston which moves reciprocally in the combustion chamber, that is, in the direction Ad indicated by the arrow in FIG. 4(B). FIG. 4(A) shows the state that the cylinder block 2 and cylinder head 3 are moved closest to the crank case 22.

When the cylinder block 2 and cylinder head 3 are moved toward the crank case 22 in the direction Ad, the stroke length of the piston in the combustion chamber becomes short and at this time, the mechanical compression ratio in the combustion chamber becomes large. On the other hand, when the cylinder block 2 and cylinder head 3 are moved away from the crank case 22 in the direction Au, the stroke length of the piston in the combustion chamber becomes long and at this time, the mechanical compression ratio in the combustion chamber becomes small.

The intake valve cam shaft 6 has cams (not shown) for opening and closing intake valves (not shown) and is positioned on the cylinder head 3 so as to be able to rotate around the axis thereof. When the intake valve cam shaft is rotated, the intake valves are driven by the cams provided thereon. A spur gear (hereinafter, referred to as—intake valve cam shaft gear—) provided with teeth on the periphery thereof is mounted on one end of the intake valve cam shaft 6 such that the central axis of the spur gear aligns with the axis of the intake valve cam shaft 6. On the other hand, the exhaust valve cam shaft 7 has cams (not shown) for opening and closing exhaust valves (not shown) and is positioned on the cylinder head 3 so as to be able to rotate around the axis thereof. When the exhaust valve cam shaft is rotated, the exhaust valves are driven by the cams provided thereon. A gear (hereinafter, referred to as—exhaust valve cam shaft gear—) provided with teeth on the periphery thereof is mounted on one end of the exhaust valve cam shaft 7 at the same side as the intake valve cam shaft gear 12 such that the central axis of the gear aligns with the axis of the exhaust valve cam shaft 6.

A face gear (hereinafter, referred to as—intermediate gear—) 11 is mounted on the cylinder head 3 so as to be able to rotate around the central axis thereof.

A chain belt 14 is wounded around the intermediate, intake valve cam shaft and exhaust valve cam shaft gears 11, 12 and 13. Therefore, when the intermediate gear 11 is rotated, the intake and exhaust valve cam shaft gears 12 and 13 are rotated via the chain belt 14. That is, the rotation of the intermediate gear 11 is transmitted to the intake valve cam shaft 6 via the chain belt 14 and the intake valve cam shaft gear 12 and is transmitted to the exhaust valve cam shaft 7 via the chain belt 14 and the exhaust valve cam shaft gear 13.

The crank shaft 4 is positioned on the cylinder block 2 so as to be rotated around the axis thereof by the reciprocal movement of the piston in the combustion chamber. A face gear (hereinafter, referred to as—crank shaft gear—) 8 is mounted on one end of the crank shaft 4 such that the central axis of the face gear aligns with the axis of the crank shaft 4. Therefore, when the crank shaft 4 rotates, the crank shaft gear 8 rotates around the central axis thereof.

The rotation transmission shaft 5 is a shaft for transmitting the rotation of the crank shaft 4 to the intake and exhaust valve cam shafts 6 and 7. A spur gear (hereinafter, referred to as—crank shaft side gear—) 9 provided with teeth on the periphery thereof is mounted on the end of the rotation transmission shaft 5 at the side of the crank shaft 4. The crank shaft side gear 9 is mounted on the rotation transmission shaft 5 such that the central axis of the crank shaft side gear 9 aligns with the axis of the rotation transmission shaft 5. The crank shaft side gear 9 is meshed with the crank shaft gear 8. Therefore, the crank shaft side gear 9 is rotated around the central axis thereof by the rotation of the crank shaft gear 8. That is, the rotation of the crank shaft 4 is transmitted to the rotation transmission shaft 5 via the crank shaft gear 8 and the crank shaft side gear 9.

On the other hand, a spur gear (hereinafter, referred to as—cam shaft side gear—) 10 provided with teeth on the periphery thereof is mounted on the end of the rotation transmission shaft 5 at the side of the intake and exhaust valve cam shaft 6 and 8 remote from the crank shaft 4. The cam shaft side gear 10 is mounted on the rotation transmission shaft 5 such that the central axis of the cam shaft side gear 10 aligns with the axis of the rotation transmission shaft 5. The cam shaft side gear 10 is meshed with the intermediate gear 11. Therefore, the intermediate gear 10 is rotated around the central axis thereof by the rotation of the rotation transmission shaft 5. That is, the rotation of the rotation transmission shaft 5 is transmitted to the intake and exhaust valve cam shafts 12 and 13 via the cam shaft side gear 10, the intermediate gear 11 and the chain belt 14.

To summarize the above explanation, the rotation of the crank shaft 4 is transmitted to the intake and exhaust valve cam shaft 6 and 7, respectively via the crank shaft gear 8, the crank shaft side gear 9, the rotation transmission shaft 5, the cam shaft side gear 10, the intermediate gear 11, the chain belt 14, and the intake and exhaust valve cam shaft gears 12 and 13.

Figure 2:
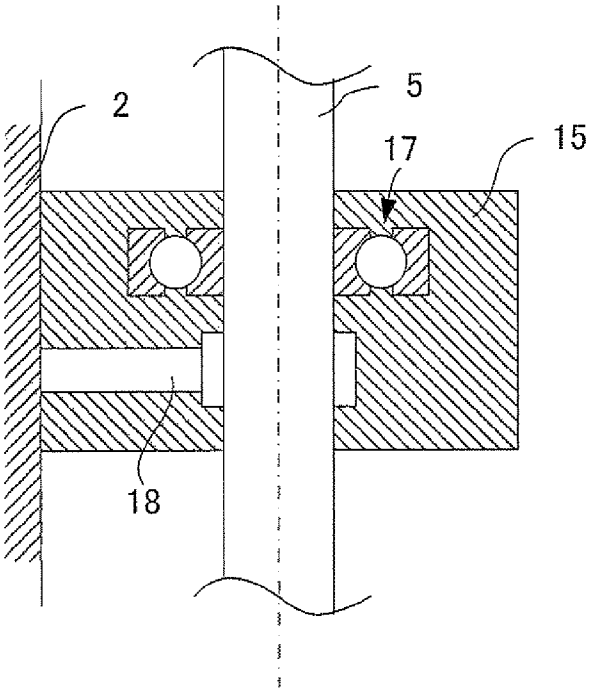
FIG. 2 is a view showing the support members for supporting the rotation transmission shaft in the first embodiment.
Figure 2:
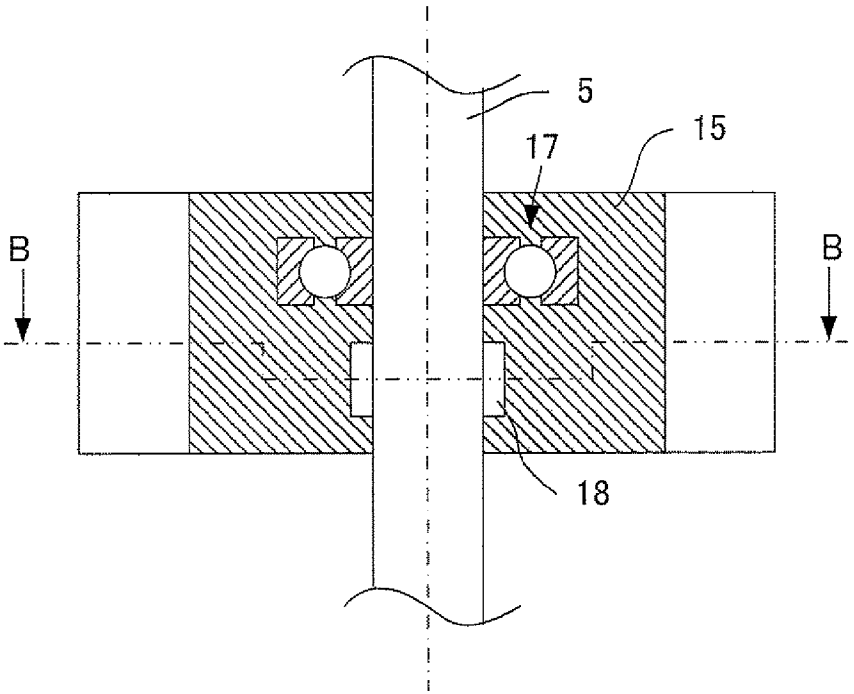

Further, the rotation transmission shaft 5 is a straight shaft and is positioned so as to extend in the direction that the cylinder block 2 and the cylinder head 3 move relative to the crank case 22, that is, in the direction of the reciprocal movement of the piston in the combustion chamber. The rotation transmission shaft 5 is rotatably supported on the crank case 22 by a support member 15 at the position relatively near the crank shaft 4. On the other hand, the rotation transmission shaft 5 is rotatably supported on the cylinder block 2 by a support member 16 at the position relatively near the intermediate gear 11. As shown in FIG. 2, the support member 15 supports the rotation transmission shaft 5 by a ball bearing 17 so as to rotate around the axis of the rotation transmission shaft 5. The support member 15 has a oil passage 18, through which lubrication oil for lubricating the ball bearing 17 flows. Another support member 16 has the same constitution as that of the support member 15.

Figure 3:
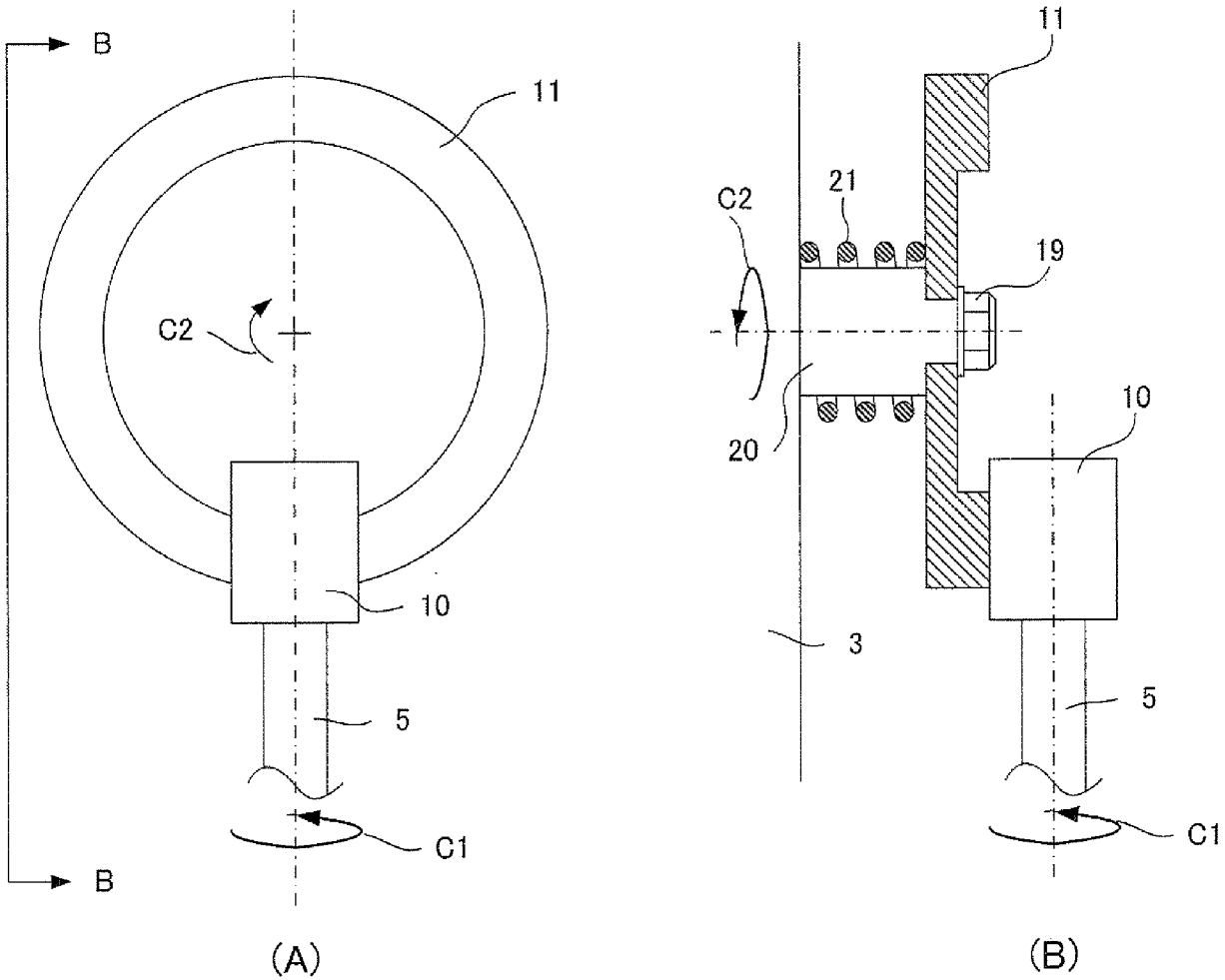
FIG. 3(A) is a front view showing the intermediate and cam shaft side gears of the first embodiment and FIG. 3(B) is a side view along the line B-B of FIG. 3(A).

Next, the meshing of the cam shaft side gear 10 with the intermediate gear 11 will be explained, referring to FIG. 3. As shown in FIG. 3, the cam shaft side gear 10 mounted on the rotation transmission shaft 5 is meshed with the lower portion of the intermediate gear 11. When the rotation transmission shaft 5 and the cam shaft side gear 10 rotate in the direction indicated by the arrow C1, the intermediate gear 11 is rotated in the direction indicated by the arrow C2. As shown in FIG. 3(B), the intermediate gear 11 is mounted on a shaft 20 by a bolt 19. The shaft 20 is mounted on the cylinder head 3 so as to be able to rotate around the axis of the shaft 20. A spring 21 is positioned between the wall face opposite to the cam shaft side gear 10 and the wall face of the cylinder head 3. The intermediate gear 11 is biased by the spring 21 so as to be pressed to the cam shaft side gear 10.

As explained above, the cylinder block 2 is mounted on the crank case 22 so as to be able to move relative to the crank case 22 in the direction of the reciprocal movement of the piston which moves reciprocally in the combustion chamber. As understood referring to the FIGS. 4(A) and 5(A) showing the state when the cylinder block 2 is at the position closest to the crank case 22 and FIGS. 4(B) and 5(B) showing the state when the cylinder block 2 is at the position remotest from the crank case, the cylinder block 2 can move relative to the crank case 22 between the positions shown in FIGS. 4(A) and 4(B). When the cylinder block 2 is moved from the position shown in FIG. 4(A) to the position shown in FIG. 4(B), the cylinder block 2 is moved by the distance D relative to the crank case 22. In this case, the stroke length of the piston in the combustion chamber at the condition shown in FIG. 4(B) is longer than that at the condition shown in FIG. 4(A). At this time, the mechanical compression ratio in the combustion chamber at the condition shown in FIG. 4(B) is smaller than that at the condition shown in FIG. 4(A). On the other hand, when the cylinder block 2 is moved from the position shown in FIG. 4(B) to the position shown in FIG. 4(A), the cylinder block 2 is moved by the distance D relative to the crank case 22. In this case, the stroke length of the piston in the combustion chamber at the condition shown in FIG. 4(A) is shorter than that at the condition shown in FIG. 4(B). At this time, the mechanical compression ratio in the combustion chamber at the condition shown in FIG. 4(A) is larger than that at the condition shown in FIG. 4(B).

Figure 4:
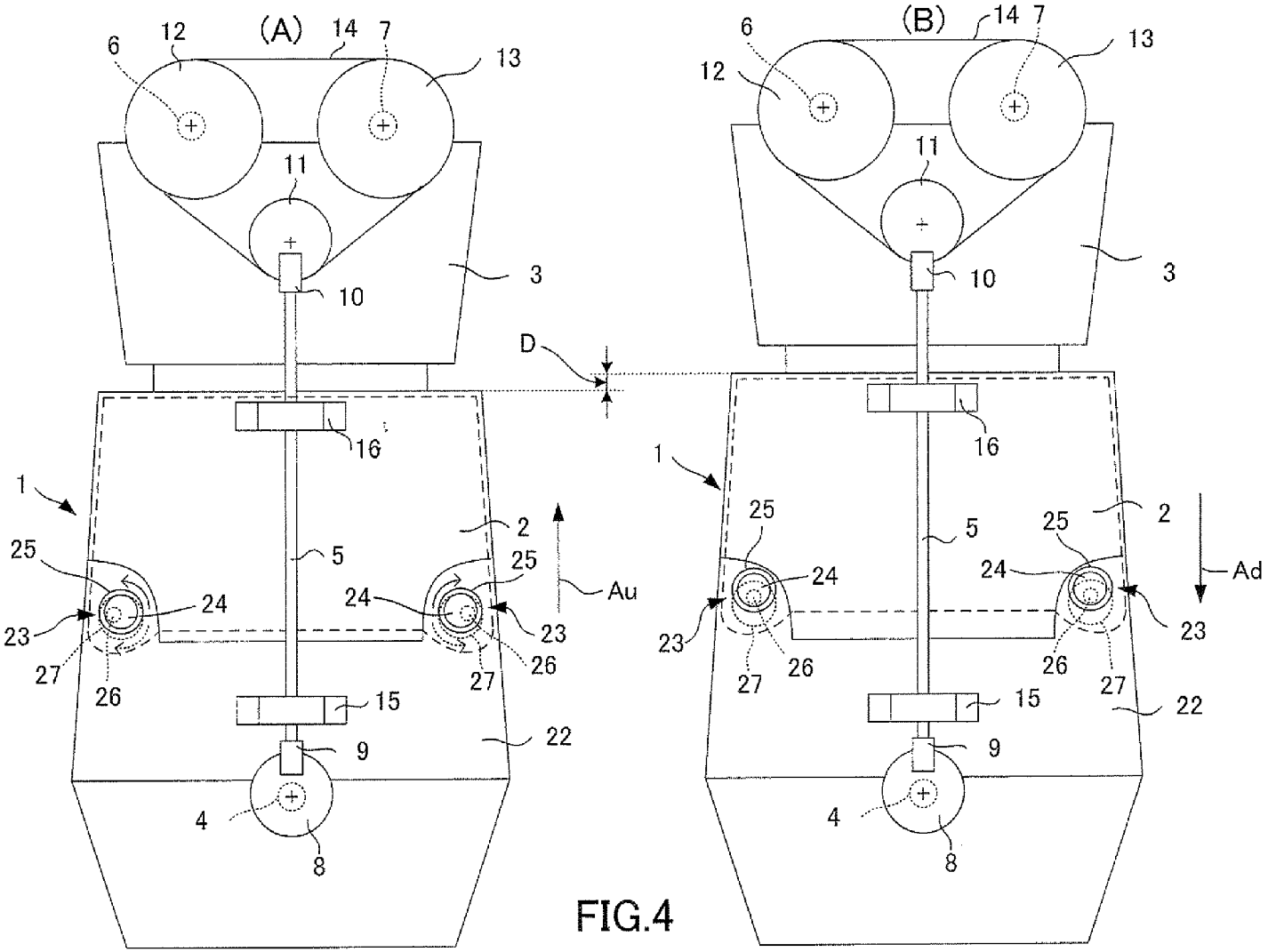
FIG. 4 is a view similar to FIG. 1
Figure 5:
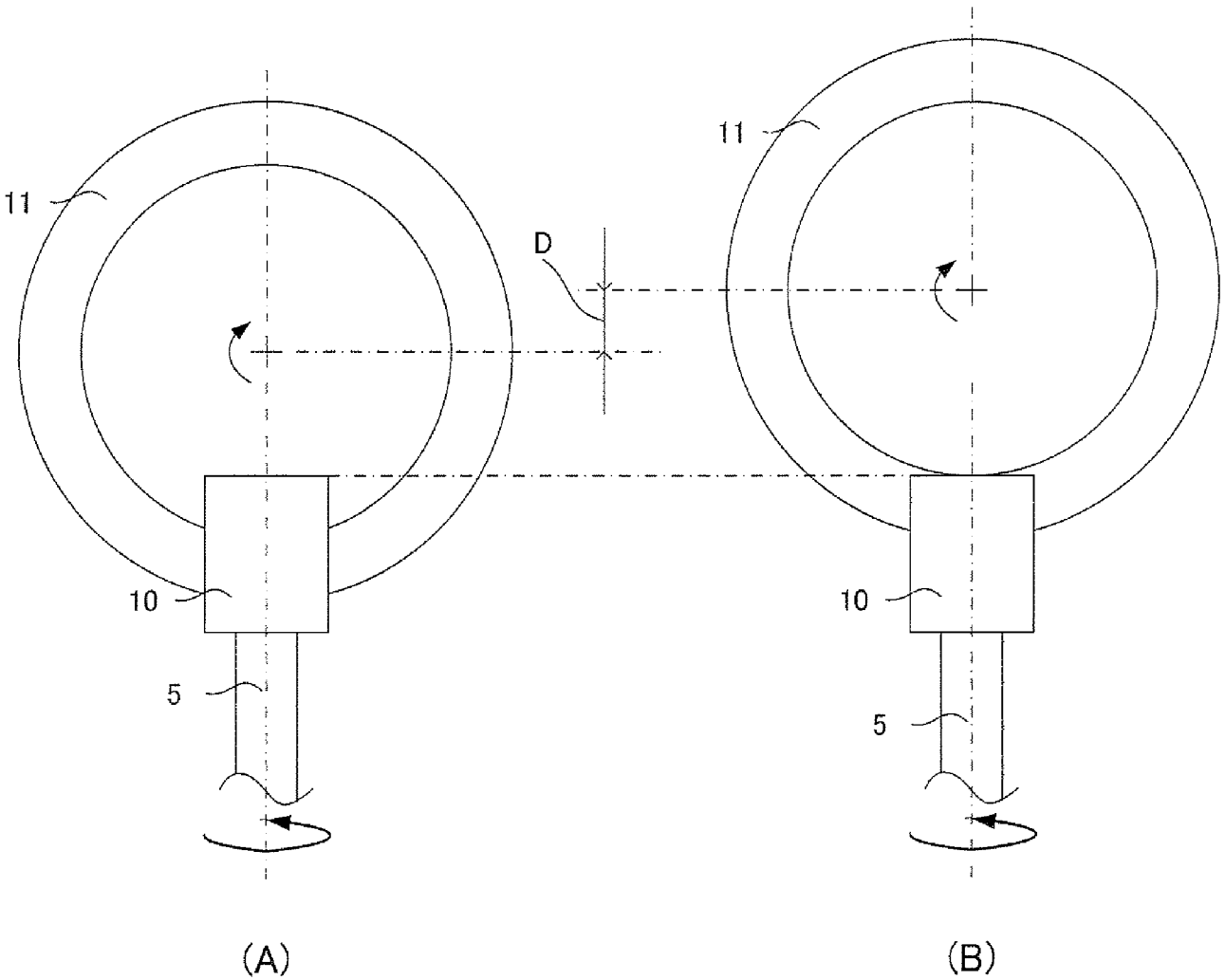

As understood referring to FIG. 4, when the cylinder block 2 and the cylinder head 3 is moved away from the crank case 22, the intermediate gear 11 is moved away from the crank case 22 along with the movement of the cylinder head 3. The cam shaft side gear 10 to be meshed with the intermediate gear 11 is mounted on the rotation transmission shaft 5 and the rotation transmission shaft 5 is supported on the cylinder block 2. Therefore, even when the cylinder block 2 and the cylinder head 3 is moved away from the crank case 22, the cam shaft side gear 10 is not moved relative to the crank case 22. Therefore, at this time, as clearly understood referring to FIG. 5, the intermediate gear 11 is moved away from the cam shaft side gear 10 along with the movement of the cylinder head 3. At this time, the condition of the meshing of the intermediate gear 11 with the cam shaft side gear 10 can be maintained. That is, in the first embodiment, the teeth of the intermediate and cam shaft side gears 11 and 10 are dimensioned such that the intermediate gear 11 meshes with the cam shaft side gear 10 even when the intermediate gear 11 is moved to the position shown in FIG. 4(B) along with the movement of the cylinder head 3. Therefore, according to the first embodiment, even when the cylinder head is moved away from the crank case 22, the rotation of the crank shaft 4 is transmitted to the intermediate gear 11, and thus to the intake and exhaust valve cam shafts 6 and 7 via the rotation transmission shaft 5.

On the other hand, as understood referring to FIG. 4, when the cylinder block 2 and the cylinder head 3 is moved toward the crank case 22, the intermediate gear 11 is moved toward the crank case 22 along with the movement of the cylinder head 3. Therefore, at this time, as clearly understood referring to FIG. 5, the intermediate gear 11 is moved toward the cam shaft side gear 10 along with the movement of the cylinder head 3. At this time, the condition of the meshing of the intermediate gear 11 with the cam shaft side gear 10 can be maintained. That is, in the first embodiment, the teeth of the intermediate and cam shaft side gears 11 and 10 are dimensioned such that the intermediate gear 11 meshes with the cam shaft side gear 10 even when the intermediate gear 11 is moved to the position shown in FIG. 4(A) along with the movement of the cylinder head 3. Therefore, according to the first embodiment, even when the cylinder block 2 and cylinder head 3 are moved toward the crank case 22, the rotation of the crank shaft 4 is transmitted to the intermediate gear 11, and thus to the intake and exhaust valve cam shafts 6 and 7 via the rotation transmission shaft 5.

As explained above, in the first embodiment, the intermediate gear 11 is biased by the spring 21 so as to be pressed to the cam shaft side gear 10. Thereby, even when the intermediate gear 11 is positioned at the either position shown in FIGS. 4(A) and 4(B), the cam shaft side gear 10 meshes sufficiently with the intermediate gear 11.

It should be noted that in the first embodiment, any gear other than the spur gear can be employed, provided that it can slide relative to the intermediate gear in the direction of the movement of the cylinder head relative to the crank case such that the meshing thereof with the intermediate gear is maintained when the cylinder block and the cylinder head are moved relative to the crank case. Further, it should be noted that the first embodiment can be applied to an internal engine that the rotation of the cam shaft side gear is transmitted to the intake and exhaust valve cam shafts via the intake or exhaust valve cam shaft gear, not via the intermediate gear, that is, an internal engine that the cam shaft side gear is meshed directly with the intake or exhaust valve cam shaft. Therefore, in consideration of these circumstances, when the gear to be meshed with the cam shaft side gear is collectively referred to as input gear, the first embodiment may be broadly constituted such that the input gear and the cam shaft side gear can slide relative to each other in the direction of the movement of the cylinder head relative to the crank case such that the meshing of the input gear with the cam shaft side gear is maintained when the cylinder block and the cylinder head are moved relative to the crank case.

Further, it should be noted that means other than the spring, for example, an elastic body such as rubber can be employed, provided that it can press the intermediate gear to the cam shaft side gear. Therefore, in consideration of these circumstances, in the first embodiment, means for biasing the intermediate gear to press the intermediate gear to the cam shaft side gear may be employed. Further, it should be noted that means for pressing the cam shaft side gear to the intermediate gear may be employed. Obviously, in the first embodiment, means for pressing the intermediate gear to the cam shaft side gear and means for pressing the cam shaft side gear to the intermediate gear may be employed. Therefore, in consideration of these circumstances, when the gear to be meshed with the cam shaft side gear is collectively referred to as—input gear—, the first embodiment may be broadly constituted such that at least one of the input and cam shaft side gears is biased against the other such that the input and cam shaft side gear are pressed toward each other.

Further, the first embodiment can be applied to an internal engine constituted such that the crank shaft side gear is moved relative to the crank shaft gear along with the movement of the cylinder head when the cylinder block and the cylinder head are moved relative to the crank case. Further, in this case, the first embodiment can be applied to an internal engine that the crank shaft side gear meshes with an intermediate gear(s) to be meshed with the crank shaft gear without meshing the crank shaft side gear directly with the crank shaft gear, that is, an internal engine that the rotation of the crank shaft is transmitted to the crank shaft side gear via the crank shaft and intermediate gear(s). Therefore, in consideration of these circumstances, when the gear to be meshed with the crank shaft side gear is collectively referred to as—output shaft—, the first embodiment can be broadly constituted such that the output and crank shaft side gears can slide relative to each other in the direction of the movement of the cylinder block and the cylinder head relative to the crank case such that the meshing of the output gear with the crank shaft side gear is maintained when the cylinder block and the cylinder head are moved relative to the crank case.

Obviously, in the case that the first embodiment is applied to the internal engine constituted such that the crank shaft side gear moves relative to the crank shaft gear along with the movement of the cylinder block and the cylinder head when the cylinder block and the cylinder head are moved relative to the crank case, means for pressing the crank shaft gear to the crank shaft sided gear and/or means for pressing the crank shaft side gear to the crank shaft gear can be employed. Therefore, in consideration of these circumstances, when the gear to be meshed with the cam shaft side gear is collectively referred to as—output gear—, the first embodiment can be broadly constituted such that one of the output and crank shaft side gears is biased against the other such that the output and crank shaft side gear are pressed toward each other.

Further, in the first embodiment, the support member near the cam shaft side gear may be mounted on the cylinder head or on the crank case. Therefore, in consideration of this circumstance, the first embodiment can be broadly constituted such that the rotation transmission shaft is supported by the support member on the cylinder block or the cylinder head or the crank case at the position near the cam shaft side gear as possible.

Further, in the first embodiment, one shaft which is folded at the universal joint which connects two shaft portions to each other can be employed as the rotation transmission shaft. In this case, the rotation transmission shaft is positioned on the cylinder block such that the axis of the shaft portion near the cylinder head is parallel to the direction of the movement of the cylinder block and the cylinder head relative to the crank case.

Further, in the first embodiment, the rotation axis of the cam shaft side gear may not intersect the rotation axis of the intermediate gear perpendicularly.

Figure 6:
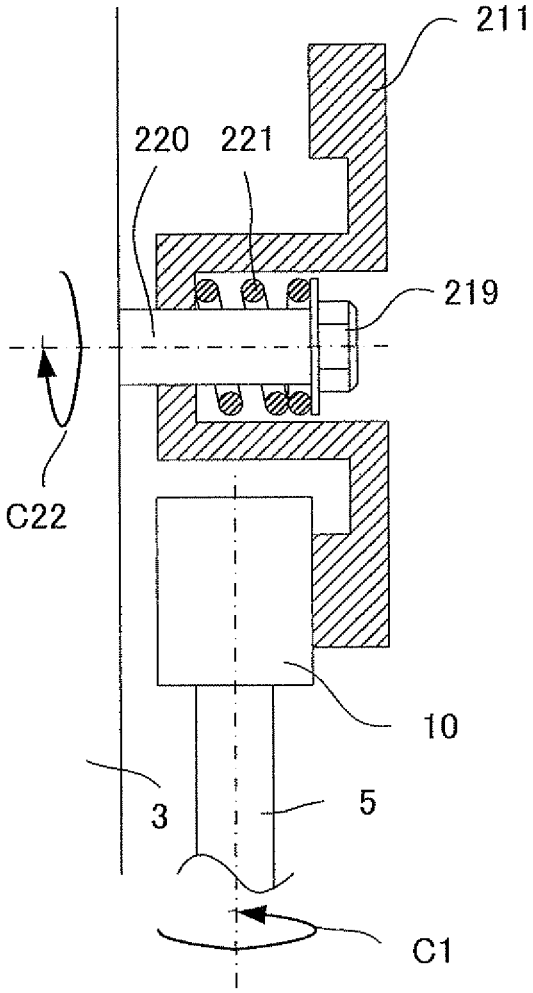
FIG. 6 is a view similar to FIG. 3(B) and shows the intermediate and cam shaft side gears of the second embodiment.

Further, a constitution shown in FIG. 6 can be employed as the constitution of the intermediate gear and the parts associated therewith. That is, in the embodiment (hereinafter, referred to as—second embodiment—) shown in FIG. 6, an intermediate gear 211 is mounted on a shaft 220 by a bolt 219, which shaft 220 is rotatably mounted on the cylinder head 3. The cam shaft side gear 10 of the rotation transmission shaft 5 is meshed with the teeth provided on the face of the intermediate gear 211 opposite to the cylinder head 3. The intermediate gear 211 is biased toward the cam shaft side gear 10 by a spring 221 such that the intermediate gear is pressed to the cam shaft side gear 10. In this embodiment, when the rotation transmission shaft 5 is rotated in the direction indicated by the arrow C1, the intermediate gear 211 is rotated in the direction C22 opposite to the direction C2 of the first embodiment. That is, according to the invention, the rotation direction of the intermediate gear can be selected, depending on whether the constitution of the intermediate and cam shaft side gears shown in FIG. 3 or the constitution of the intermediate and cam shaft side gears shown in FIG. 6 is selected. Therefore, the invention can be easily applied to two internal engines that the direction of the rotation of the intermediate gear of one of the engine is different from that of the other engine.

Figure 7:
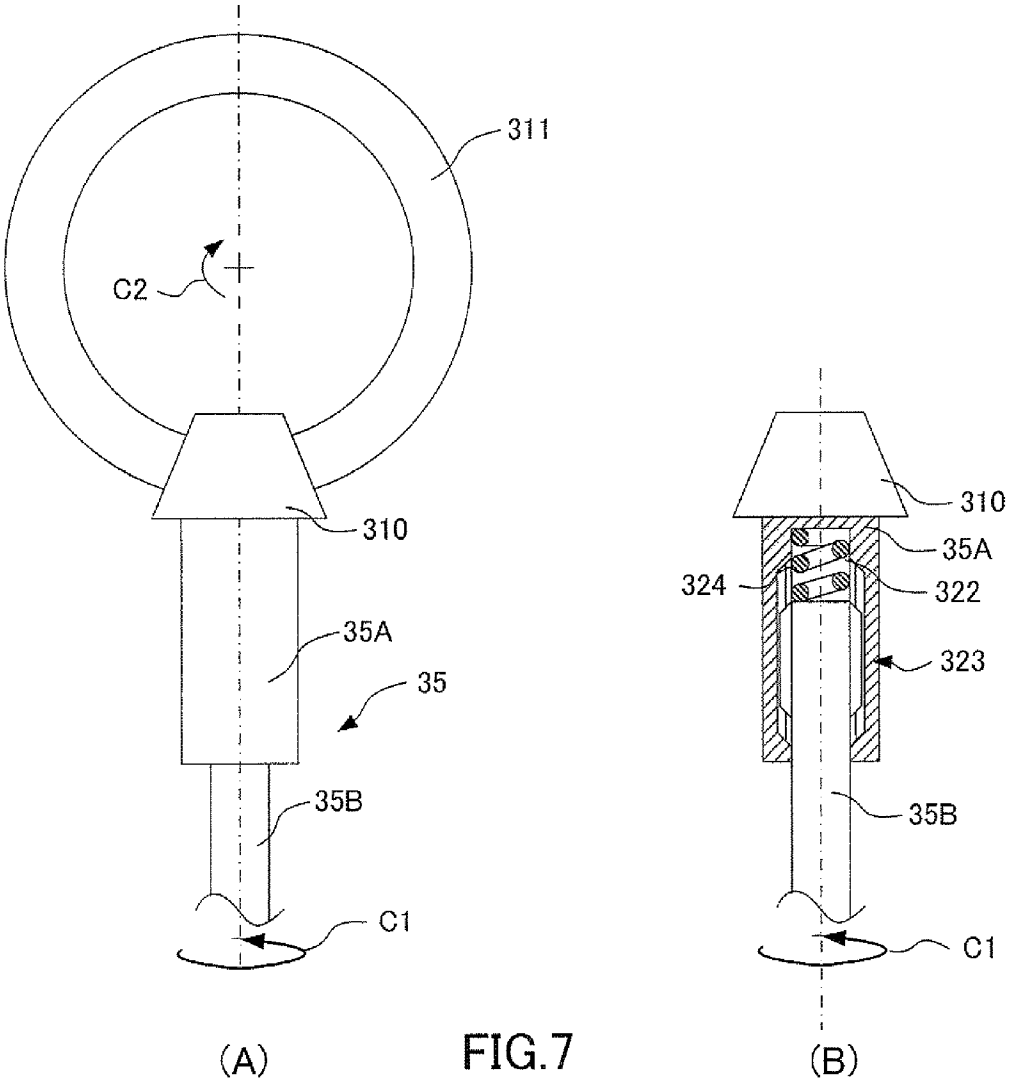
FIG. 7(A) is a front view showing the intermediate and cam shaft side gears of the third embodiment and FIG. 7(B) is a partial sectional view of the cam shaft side gear of the third embodiment.

A constitution shown in FIG. 7 may be employed in place of the rotation transmission shaft, the cam shaft side gear mounted on the rotation transmission shaft, the intermediate gear meshed with the cam shaft side gear and the parts associated thereto of the above-explained embodiments. That is, in the embodiment (hereinafter, referred to as—third embodiment—) shown in FIG. 7, a cam shaft side gear 310 is mounted on one end of a rotation transmission shaft 35. The cam shaft side gear 310 of this embodiment is a bevel gear.

The rotation transmission shaft 35 of this embodiment is constituted by two shaft portions 35A and 35B. The shaft portions 35A and 35B are straight shafts. The cam shaft side gear 310 is mounted on the end of the shaft portion 35A. On the other hand, the crank shaft side gear (not shown) is mounted on the end of the shaft portion 35B.

As shown in detail in FIG. 7(B), the shaft portions 35A and 35B are connected to each other so as such that the shaft portion 35A telescopically overlaps the shaft portion 35B and can slide relative to the shaft portion 35B. That is, a cavity 322 is formed in the shaft portion 35A. The cavity 322 extends axially from the end thereof opposite to the end thereof where the cam shaft side gear 310 is mounted. Teeth each extending axially are formed circumferentially, spacing by predetermined distance on the inner circumferential wall face defining the cavity 322. On the other hand, a plurality of grooves each extending axially are formed circumferentially, spacing by predetermined distance on the outer circumferential wall face of the shaft portion 35B.

The shaft portion 35B is inserted into the cavity 322 of the shaft portion 35A such that the grooves formed on the outer circumferential wall face of the shaft portion 35B fit the teeth formed on the inner circumferential wall face of the shaft portion 35A. That is, the shaft portions 35A and 35B are connected to each other such that the shaft portion 35A can slide relative to the shaft portion 35B and cannot rotate relative to the shaft portion 358.

Further, a spring 324 is positioned in the cavity 322 of the shaft portion 35A and between the end wall face of the shaft portion 35B and the inner wall face defining the cavity 322 of the shaft portion 35A opposite to the above-mentioned end wall face of the shaft portion 35B. The spring 324 biases the shaft portions 35A and 35B so as to axially move the shaft portions 35A and 35B apart from each other.

Figure 8:
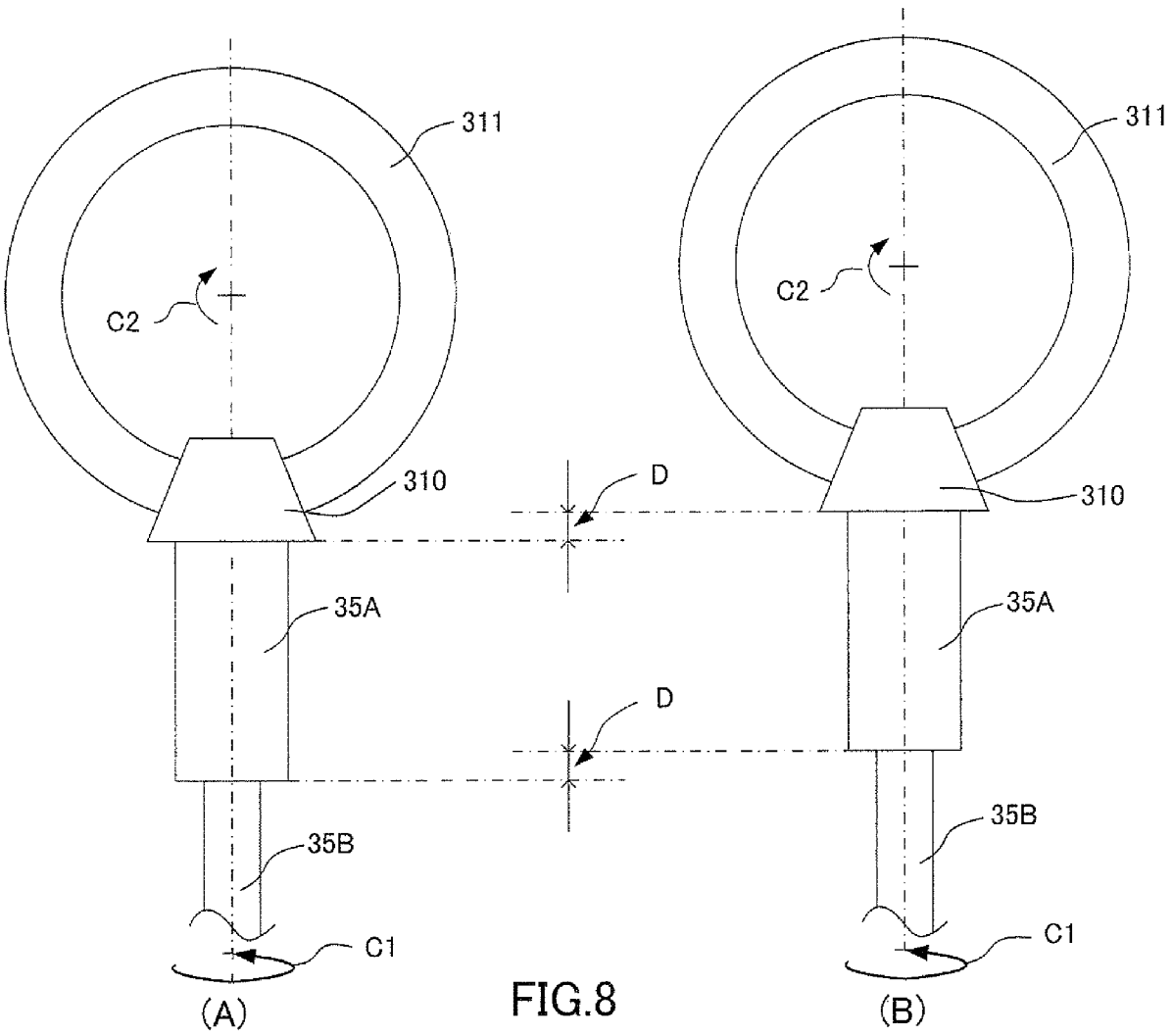

In the third embodiment, the cylinder block is mounted on the crank case 22 to be able to move relative to the crank case in the direction of the reciprocal movement of the piston which moves reciprocally in the combustion chamber. Referring to the FIG. 8(A) showing a state when the cylinder block is positioned closest to the crank case and FIG. 8(B) showing a state when the cylinder block is positioned remotest from the crank case, the cylinder head, that is, the intermediate gear 311 can move relative to the crank case between the positions shown in FIGS. 8(A) and 8(B). When the intermediate gear 311 is moved from the position shown in FIG. 8(A) to the position shown in FIG. 8(B), the cylinder block and the cylinder head are moved relative to the crank case by the distance D. In this case, the stroke length of the piston in the combustion chamber at the condition shown in FIG. 8(B) is longer than that at the condition shown in FIG. 8(A). In this case, the mechanical compression ratio in the combustion chamber at the condition shown in FIG. 8(B) is smaller than that at the condition shown in FIG. 8(A). Obviously, when the intermediate gear 311 is moved from the position shown in FIG. 8(B) to the position shown in FIG. 8(A), the cylinder block and cylinder head are moved by the distance D relative to the crank case. In this case, the stroke length of the piston in the combustion chamber at the condition shown in FIG. 8(A) is shorter than that at the condition shown in FIG. 8(B). At this time, the mechanical compression ratio in the combustion chamber at the condition shown in FIG. 8(A) is larger than that at the condition shown in FIG. 8(B).

In the third embodiment, when the cylinder block and the cylinder head are moved away from the crank case, the intermediate gear 311 is moved away from the crank case along with the movement of the cylinder head. At this time, the shaft portion 35A is moved away from the shaft portion 35B in the axial direction of the rotation transmission shaft 35 by the biasing force of the spring 324. At this time, the relative positional relationship between the shaft portion 35A and the intermediate gear 311 dose not change. Therefore, the meshing of the cam shaft side gear 310 with the intermediate gear 311 is maintained. On the other hand, when the cylinder block and the cylinder head is moved toward the crank case, the intermediate gear 311 is moved toward the crank case along with the movement of the cylinder head. At this time, the shaft portion 35A is moved toward the shaft portion 35B by the intermediate gear 311 against the biasing force of the spring 324. At this time, the relative positional relationship between the shaft portion 35A and the intermediate gear 311 does not change. Therefore, the meshing of the cam shaft side gear 310 with the intermediate gear 311 is maintained.

It should be noted that a constitution may be employed in place of or in addition to the constitution of the rotation transmission shaft of the above-explained third embodiment. That is, in the embodiment (hereinafter, referred to as—fourth embodiment—) shown in FIG. 9, the rotation transmission shaft 45 is constituted by two shaft portions 45A and 45B and the shaft portions 45A and 45B are connected to each other such that the shaft portion 45A telescopically overlaps the shaft portion 45B and can slide relative to the shaft portion 45B. In this embodiment, a cavity 422 is formed in the shaft portion 45B positioned at the side remote from the intermediate gear 311 and the other shaft portion 45A is inserted into the cavity 422. The shaft portions 45A and 45B are connected to each other by a ball spline 423 such that the shaft portion 45 A can slide relative to the shaft portion 45B and cannot rotate relative to the shaft portion 45B. A spring 424 for biasing the shaft portions 45A and 45B such that the shaft portions 45A and 45B are axially moved away from each other, is positioned in the cavity 422

By employing the constitution that the shaft portion 45A positioned near the cylinder head is inserted into the cavity 422 formed in the shaft portion 45B positioned remote from the cylinder head, the following advantage can be obtain. That is, generally, the cylinder head is positioned above the cylinder block. Therefore, the shaft portion 45A positioned near the cylinder head is positioned above the shaft portion 45B positioned remote from the cylinder head. Therefore, the opening of the cavity 422 formed in the shaft portion 45B opens upward. Therefore, in the case that the above-explained constitution is employed, the advantage that the lubrication oil easily enters into the cavity 422 and the ball spline provided in the cavity 422 is sufficiently lubricated by the lubrication oil, is obtained.

Further, by employing the ball spline in order to connect the shaft portions 45A and 45B to each other as explained above, the following advantage can be obtained. That is, in the case that the ball spline of the fourth embodiment is employed, the friction resistance when the shaft portions slide relative to each other is smaller than that in the case that the spline of the third embodiment is employed. Therefore, in the case that the ball spline is employed, the advantage that the shaft portions are moved sufficiently along with the movement of the intermediate gear when the intermediate gear moves relative to the crank case, is obtained.

It should be noted that the spline of the third embodiment may be employed in place of the ball spline of the fourth embodiment. Obviously, the ball spline of this embodiment may be employed in place of the spline of the third embodiment.

Figure 9:
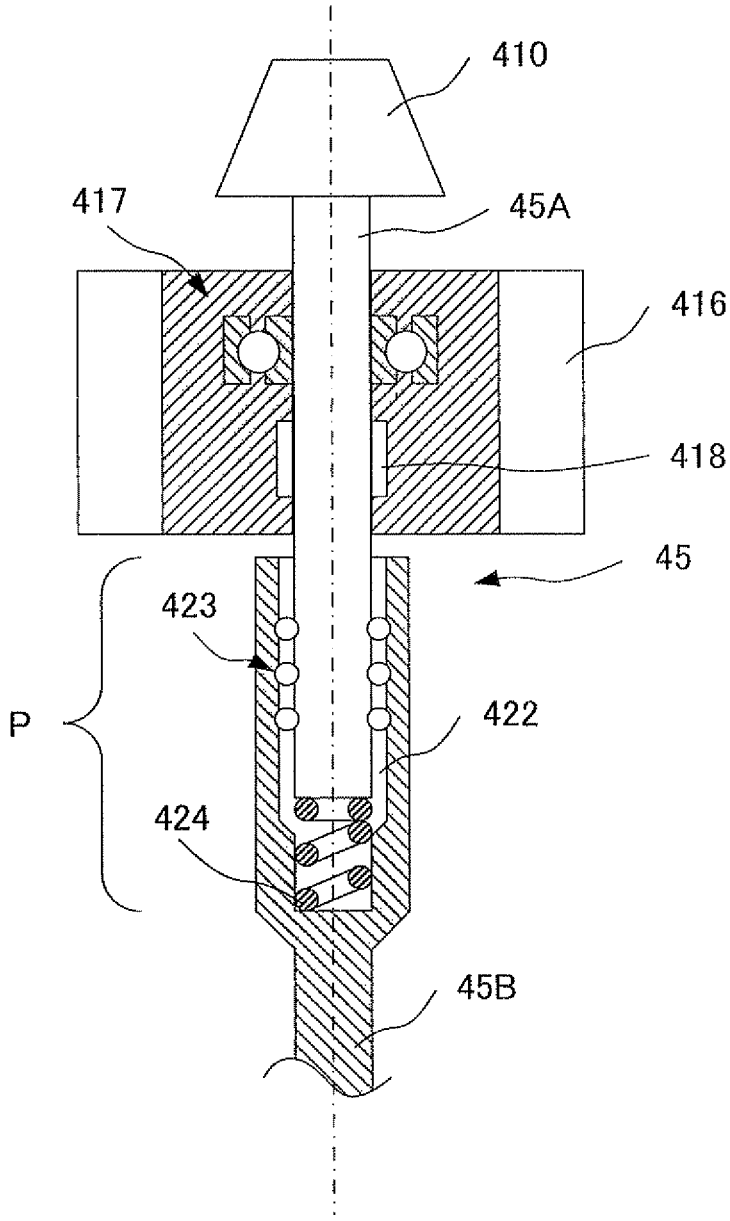
FIG. 9 is a front view showing the constitution of the cam shaft side gear and the parts associated therewith of the fourth embodiment.

Further, in the fourth embodiment, similar to the first embodiment, the rotation transmission shaft 45 is supported on the cylinder block and crank case by two support members. In the fourth embodiment, as shown in FIG. 9, the support member 416 near the cam shaft side gear 410 supports the rotation transmission shaft 45 on the cylinder block by supporting the shaft portion 45A between the sliding portion P of the shaft portions 45A and 45B, that is, the portion P where the shaft portion 45A overlaps the shaft portion 45B and the cam shaft side gear 410. It should be noted that in FIG. 9, 417 denotes a ball bearing similar to the ball bearing 17 shown in FIGS. 2 and 418 denotes an oil passage similar to the oil passage 18 shown in FIG. 2.

Figure 10:
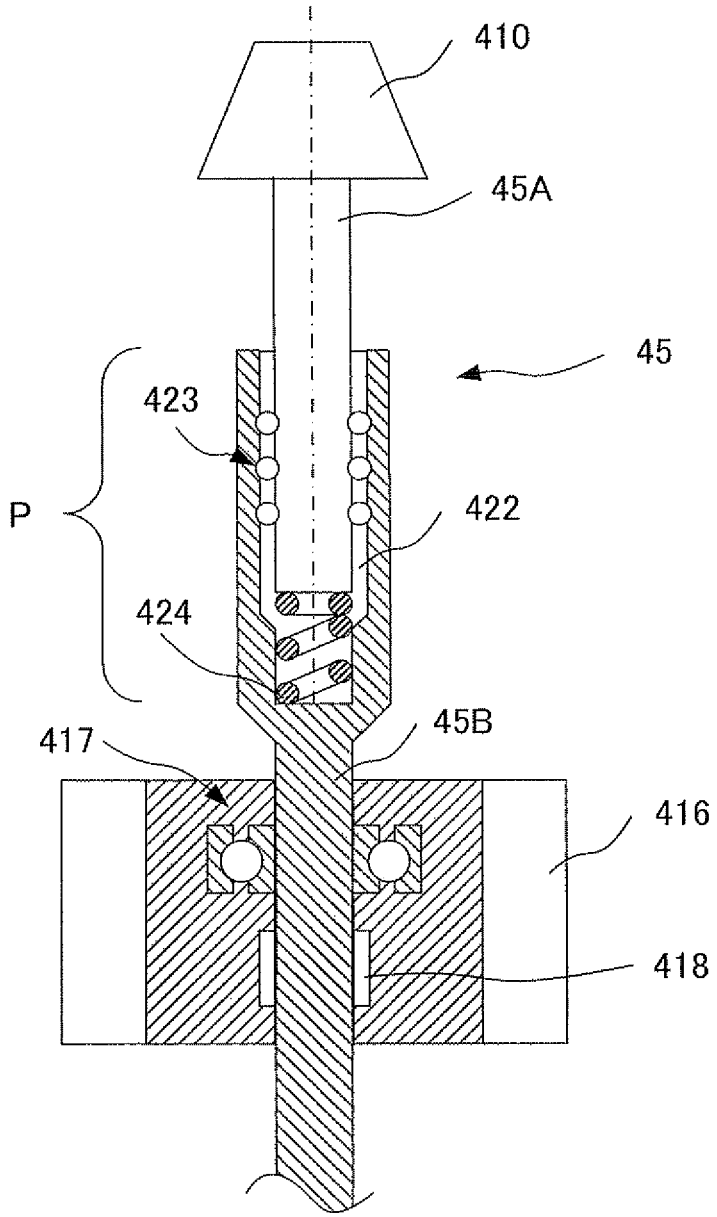
FIG. 10 is a front view showing the constitution of the cam shaft side gear and the parts associated therewith of the fifth embodiment.
Figure 11:
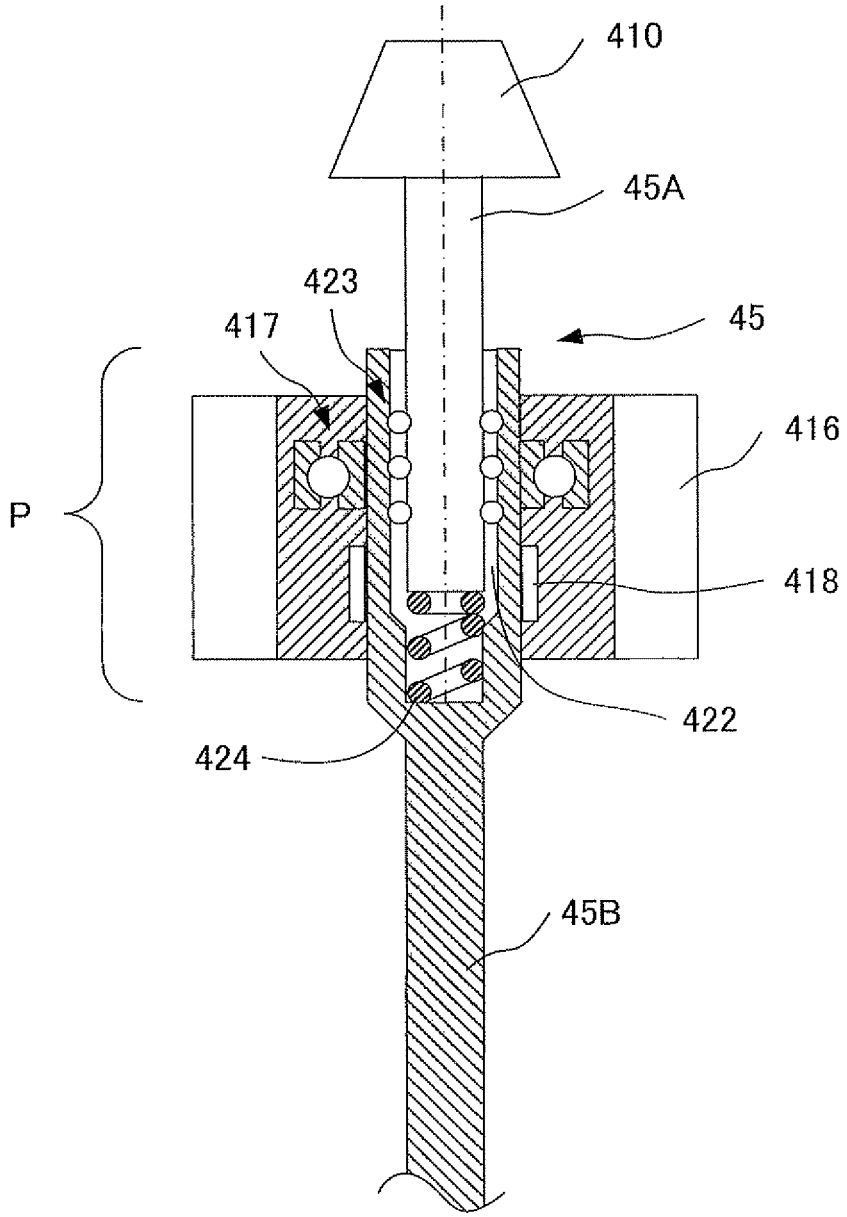
FIG. 11 is a front view showing the constitution of the cam shaft side gear and the parts associated therewith of the sixth embodiment.

It should be noted that in the fourth embodiment, a constitution shown in FIG. 10 may be employed in place of or in addition to the constitution that the shaft portion 45A is supported by the support member 417 between the sliding area of the shaft portions and the cam shaft side gear. That is, in the embodiment (hereinafter, referred to as—fifth embodiment—) shown in FIG. 10, the shaft portion 45B is supported by a support member 416 between the sliding portion P of the shaft portion 45A and 45B and the crank shaft side gear. Further, in the embodiment (hereinafter, referred to as—sixth embodiment—) shown in FIG. 11, the shaft portion 45A is supported by the support member 416 at the sliding portion P of the shaft portion 45A and 45B.

It should be noted that the constitutions of the fourth to sixth embodiments can be applied to the third embodiment.

Further, in the third to sixth embodiment, a rotation transmission shaft may be employed, which rotation transmission is constituted by more than three shaft portions connected to each other and extending along a common axis so as to be able to slide relative to each other and rotate around the common axis and so as not to be able to rotate relative to each other.

Further, the constitution of the rotation transmission shaft of each of the third to sixth embodiments can be applied to the rotation transmission shaft of the first and second embodiments.

Further, the constitution of the meshing of the cam shaft side gear with the intermediate gear in the second embodiment can be applied to the third to sixth embodiments.

Figure 12:
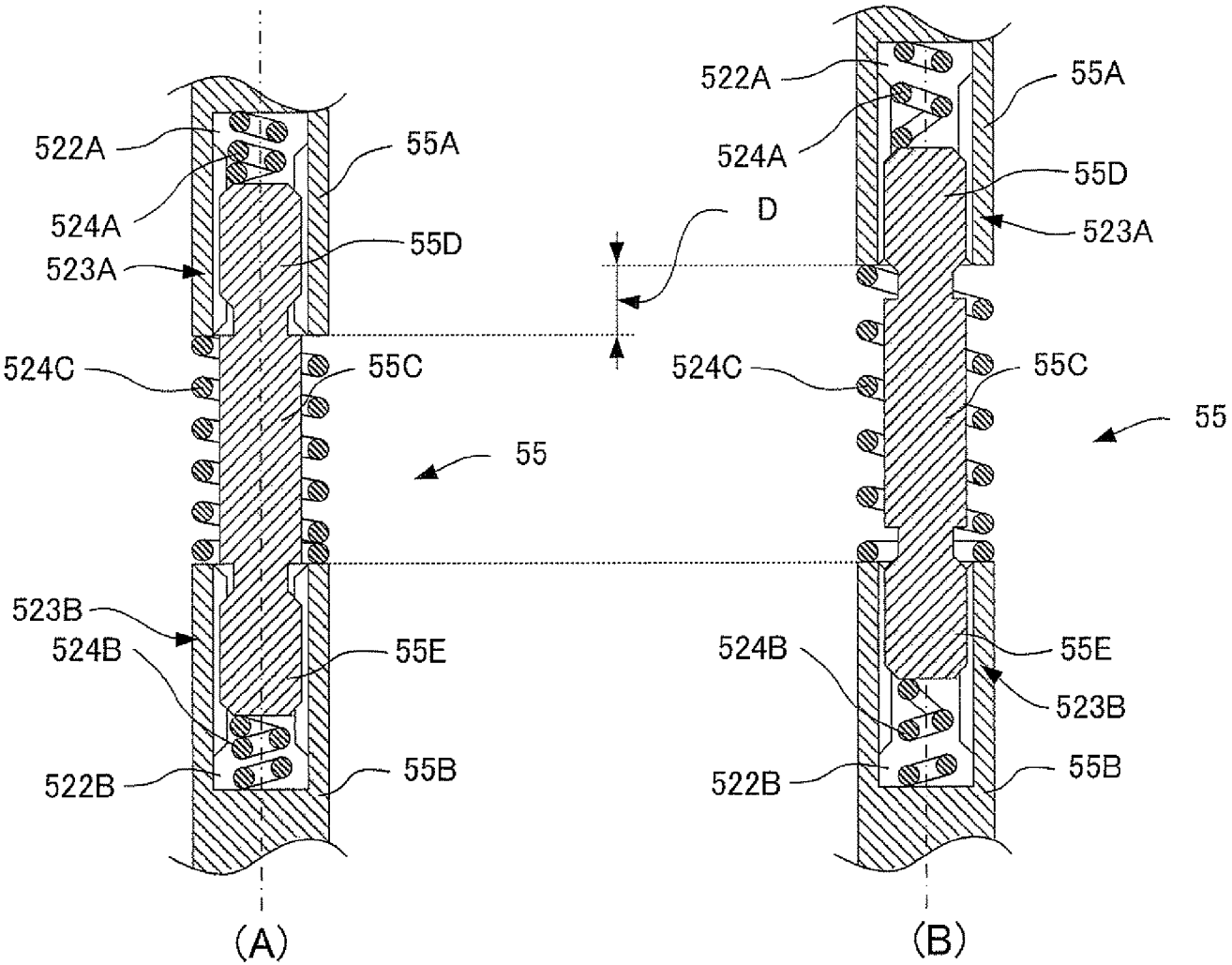

Further, a rotation transmission shaft shown in FIG. 12 may be employed in place of the rotation transmission shafts of the third to six embodiments. That is, the rotation transmission shaft 55 of the embodiment (hereinafter, referred to as—seventh embodiment—) shown in FIG. 12 is constituted by two shaft portions 55A and 55B and a connection member 55C. The shaft portions 55A and 55B and the connection member 55C are straight shafts, respectively. The cam shaft side gear (not shown) is mounted on the end of the shaft portion 55A. On the other hand, the crank shaft side gear (not shown) is mounted on the end of the shaft portion 55B.

As shown in FIG. 12, the shaft portions 55A and 558 and the connection member 55C are connected and overlap relative to each other so as to be able to slide relative to each other. That is, a cavity 522A is formed in the shaft portion 55A. The cavity 522A extends axially from the end of the shaft portion 55A opposite to the end of the shaft portion 55A where the cam shaft side gear is mounted. Teeth each extending axially are formed circumferentially, spacing by predetermined distance on the inner circumferential wall face defining the cavity 522A. On the other hand, a cavity 522B is formed in the shaft portion 55B. The cavity 522B extend axially from the end of the shaft portion 55B opposite to the end of the shaft portion 558 where the crank shaft side gear is mounted. Teeth each extending axially are formed circumferentially, spacing by predetermined distance on the inner circumferential wall face defining the cavity 522B. A plurality of grooves each extending axially are formed circumferentially, spacing by predetermined distance on the outer circumferential wall face of the both ends 55D and 55E of the connection member 55C.

The end 55D of the connection member 55C is inserted into the cavity 522A of the shaft portion 55A such that the grooves formed on the outer circumferential wall face of the end 55D of the connection member 55C fit the teeth formed on the inner circumferential wall face defining the cavity 522A of the shaft portion 55A. That is, the shaft portion 55A and the connection member 55C are connected to each other by a spline 523A so as to be able to slide relative to each other and so as not to rotate relative to each other. On the other hand, the end 55E of the connection member 55C is inserted into the cavity 522B of the shaft portion 55B such that the grooves formed on the outer circumferential wall face of the end 55E of the connection member 55C fit the teeth formed on the inner circumferential wall face defining the cavity 522B of the shaft portion 55B. That is, the shaft portion 55B and the connection member 55C are connected to each other by a spline 523B so as to be able to slide relative to each other and so as not to rotate relative to each other.

A spring 524A is positioned in the cavity 522A of the shaft portion 55A and between the end face of the connection member 55C and the inner wall face defining the cavity 522A of the shaft portion 55A opposite to the above-mentioned end face of the connection member 55C. The spring 524A biases the connection member 550 and the shaft portion 55A such that the connection member 55C and the shaft portion 55A are moved axially apart from each other. On the other hand, a spring 524B is positioned in the cavity 522B of the shaft portion 55B and between the end face of the connection member 55C and the inner wall face defining the cavity 522B of the shaft portion 55B opposite to the above-mentioned end face of the connection member 55C. The spring 524B biases the connection member 55C and the shaft portion 55B such that the connection member 55C and the shaft portion 55B are moved axially apart from each other.

A spring 524C is positioned, surrounding the connection member 55C between the end faces of the shaft portions 55A and 55B, which end faces are opposite to each other. The spring 524C biases the shaft portions 55A and 55B such that the shaft portions 55A and 558 are moved axially apart from each other.

It should be noted that FIG. 12(A) shows a state of the rotation transmission shaft when the cylinder block and the cylinder head are positioned closest to the crank case and FIG. 12(B) shows a state of the rotation transmission shaft when the cylinder block and the cylinder head are positioned remotest from the crank case. When the cylinder block and the cylinder head are moved away from the crank case, the intermediate gear is moved away from the crank case along with the movement of the cylinder head. As understood referring to FIG. 12, at this time, the shaft portion 55A is moved away from the shaft portion 55B along with the movement of the intermediate gear by the biasing force of the spring 524C. At this time, the relative positional relationship between the shaft portion 55A and the intermediate gear does not change. Therefore, the meshing of the cam shaft side gear with the intermediate gear is maintained. On the other hand, when the cylinder block and the cylinder head are moved toward the crank case, the intermediate gear is moved toward the crank case along with the movement of the cylinder head. As understood referring to FIG. 12, at this time, the shaft portion 55A is moved toward the shaft portion 55B by the intermediate gear against the biasing force of the spring 524C. At this time, the relative positional relationship between the shaft portion 55A and the intermediate gear does not change. Therefore, the meshing of the cam shaft side gear with the intermediate gear is maintained.

It should be noted that in the seventh embodiment, as understood referring to FIG. 12, when the cylinder block and the cylinder head are moved away from the crank case and when the cylinder block and the cylinder head are moved toward the crank case, the connection member 55C is positioned at the central position between the shaft portions 55A and 55B. Thereby, the connection between the connection member 55C and the shaft portion 55A and the connection between the connection member 55C and the shaft portion 55B are maintained.

It should be noted that the constitution of the rotation transmission shaft of each of the third to seventh embodiments can be applied to the first and second embodiments.

Between the first and second embodiments and the third to seventh embodiments, the common constitution for maintaining the meshing of the cam shaft side gear with the intermediate gear when the cylinder block and the cylinder head are moved relative to the crank case, is that the intermediate and cam shaft side gears are constituted such that the intermediate and cam shaft side gears can slide relative to each other in the direction of the movement of the cylinder block and the cylinder head relative to the crank case so as to maintain the mashing of the cam shaft side gear with the intermediate gear when the cylinder block and the cylinder head are moved relative to the crank case. As explained above, the first to seventh embodiments can be applied to an internal engine that the crank shaft side gear is moved relative to the crank shaft gear along with the movement of the cylinder head when the cylinder block and the cylinder head are moved relative to the crank case. The cam shaft side and crank shaft side gears may be considered as a part of the rotation transmission shaft. Therefore, in consideration of these circumstances, when the gear which the cam shaft side gear is meshed, is collectively referred to as—input gear—and the gear which the crank shaft side gear is meshed, is collectively referred to as—output gear—, the first to seventh embodiments is broadly constituted such that the input gear and the rotation transmission shaft can slide relative to each other or the output gear and the rotation transmission shaft can slide relative to each other in the direction of the movement of the cylinder block and the cylinder head relative to the crank case so as to maintain the meshing of the cam shaft side gear with the input gear or the meshing of the crank shaft side gear with the output gear when the cylinder block and the cylinder head are moved relative to the crank case.

The above-explained embodiments are ones obtained by applying the invention to the variable compression ratio internal engine that the cylinder block and the cylinder head can move relative to the crank case and the mechanical compression ratio in the combustion chamber can be varied by moving the cylinder block and the cylinder head relative to the crank case. However, the invention can be applied to a variable compression ratio internal engine constituted by at least two block portions connected to each other so as to be able to move relative to each other and constituted such that the mechanical compression ratio can be varied by moving one of the block portions relative to the other block portion.

The invention claimed is:

1. A variable compression ratio internal engine constituted by at least two block portions connected to each other so as to be able to move relative to each other and constituted such that the mechanical compression ratio in the combustion chamber can be varied by moving one of the block portions relative to the other block portion, comprising:

a cam shaft having a cam for driving an intake or exhaust valve positioned on one of the block portions;

a crank shaft positioned on the other block portion;

an output gear for outputting the rotation of the crank shaft; and an input gear for inputting the rotation output from the output gear to the cam shaft;

the engine being constituted such that the input gear moves relative to the output gear along with the movement of the one block portion when the one block portion is moved relative to the other block portion, wherein the engine further comprises a rotation transmission shaft for transmitting the rotation output from the output gear to the input gear, wherein the rotation transmission shaft has a crank shaft side gear meshed with the output gear on one end thereof and a cam shaft side gear meshed with the input gear on the other end thereof, wherein the output gear and the crank shaft side gear are meshed with each other such that the rotation transmission shaft is rotated around the axis thereof by the rotation of the crank shaft and the cam shaft side gear and the input gear are meshed with each other such that the cam shaft is rotated around the axis thereof by the rotation of the rotation transmission shaft, wherein the input gear and the rotation transmission shaft are constituted to be able to slide relative to each other or the output gear and the rotation transmission shaft are constituted to be able to slide relative to each other in the direction of the movement of the one block portion relative to the other block portion such that the meshing between the input gear and the cam shaft side gear or the meshing between the output gear and the crank shaft side gear is maintained when the one block portion is moved relative to the other block portion, wherein the input gear and the cam shaft side gear are constituted to be able to slide relative to each other in the direction of the movement of the one block portion relative to the other block portion such that the meshing between the input gear and the cam shaft side gear is maintained when the one block portion is moved relative to the other block portion, and wherein the cam shaft side gear is a spur gear.

2. The variable compression ratio internal engine as set forth in claim 1, wherein the rotation transmission shaft is supported on the block portions by a support member/support members at the position near the cam shaft side gear as possible.

3. The variable compression ratio internal engine as set forth in claim 1, wherein the rotation transmission shaft is constituted by at least two shaft portions, and the shaft portions are connected to be able to slide relative to each other in the direction of the movement of the one block portion relative to the other block portion such that the meshing between the input and cam shaft side gears or the meshing between the output and crank shaft side gears is maintained when the one block portion is moved relative to the other block portion.

4. The variable compression ratio internal engine as set forth in claim 3, wherein the shaft portions are telescopically overlapped and the telescopically overlapping parts are supported by a ball spline so as to be able to slide relative to each other.

5. The variable compression ratio internal engine as set forth in claim 3, wherein the rotation transmission shaft is supported on the block portions by a support member/support members at the position near the cam shaft side or crank shaft side gear as possible.

6. A variable compression ratio internal engine constituted by at least two block portions connected to each other so as to be able to move relative to each other and constituted such that the mechanical compression ratio in the combustion chamber can be varied by moving one of the block portions relative to the other block portion, comprising:

a cam shaft having a cam for driving an intake or exhaust valve positioned on one of the block portions;

a crank shaft positioned on the other block portion;

an output gear for outputting the rotation of the crank shaft; and an input gear for inputting the rotation output from the output gear to the cam shaft;

the engine being constituted such that the input gear moves relative to the output gear along with the movement of the one block portion when the one block portion is moved relative to the other block portion, wherein the engine further comprises a rotation transmission shaft for transmitting the rotation output from the output gear to the input gear, wherein the rotation transmission shaft has a crank shaft side gear meshed with the output gear on one end thereof and a cam shaft side gear meshed with the input gear on the other end thereof, wherein the output gear and the crank shaft side gear are meshed with each other such that the rotation transmission shaft is rotated around the axis thereof by the rotation of the crank shaft and the cam shaft side gear and the input gear are meshed with each other such that the cam shaft is rotated around the axis thereof by the rotation of the rotation transmission shaft, wherein the input gear and the rotation transmission shaft are constituted to be able to slide relative to each other or the output gear and the rotation transmission shaft are constituted to be able to slide relative to each other in the direction of the movement of the one block portion relative to the other block portion such that the meshing between the input gear and the cam shaft side gear or the meshing between the output gear and the crank shaft side gear is maintained when the one block portion is moved relative to the other block portion, wherein the input gear and the cam shaft side gear are constituted to be able to slide relative to each other in the direction of the movement of the one block portion relative to the other block portion such that the meshing between the input gear and the cam shaft side gear is maintained when the one block portion is moved relative to the other block portion, and wherein at least one of the input and cam shaft side gears is biased against the other thereof such that the input and cam shaft side gears are pressed toward each other.

7. The variable compression ratio internal engine as set forth in claim 6, wherein the rotation transmission shaft is supported on the block portions by a support member/support members at the position near the cam shaft side gear as possible.

8. The variable compression ratio internal engine as set forth in claim 6, wherein the rotation transmission shaft is constituted by at least two shaft portions, and the shaft portions are connected to be able to slide relative to each other in the direction of the movement of the one block portion relative to the other block portion such that the meshing between the input and cam shaft side gears or the meshing between the output and crank shaft side gears is maintained when the one block portion is moved relative to the other block portion.

9. The variable compression ratio internal engine as set forth in claim 8, wherein the shaft portions are telescopically overlapped and the telescopically overlapping parts are supported by a ball spline so as to be able to slide relative to each other.

10. The variable compression ratio internal engine as set forth in claim 8, wherein the rotation transmission shaft is supported on the block portions by a support member/support members at the position near the cam shaft side or crank shaft side gear as possible.

11. A variable compression ratio internal engine constituted by at least two block portions connected to each other so as to be able to move relative to each other and constituted such that the mechanical compression ratio in the combustion chamber can be varied by moving one of the block portions relative to the other block portion, comprising:

a cam shaft having a cam for driving an intake or exhaust valve positioned on one of the block portions;

a crank shaft positioned on the other block portion;

an output gear for outputting the rotation of the crank shaft; and an input gear for inputting the rotation output from the output gear to the cam shaft;

the engine being constituted such that the input gear moves relative to the output gear along with the movement of the one block portion when the one block portion is moved relative to the other block portion, wherein the engine further comprises a rotation transmission shaft for transmitting the rotation output from the output gear to the input gear, wherein the rotation transmission shaft has a crank shaft side gear meshed with the output gear on one end thereof and a cam shaft side gear meshed with the input gear on the other end thereof, wherein the output gear and the crank shaft side gear are meshed with each other such that the rotation transmission shaft is rotated around the axis thereof by the rotation of the crank shaft and the cam shaft side gear and the input gear are meshed with each other such that the cam shaft is rotated around the axis thereof by the rotation of the rotation transmission shaft, and wherein the input gear and the rotation transmission shaft are constituted to be able to slide relative to each other or the output gear and the rotation transmission shaft are constituted to be able to slide relative to each other in the direction of the movement of the one block portion relative to the other block portion such that the meshing between the input gear and the cam shaft side gear or the meshing between the output gear and the crank shaft side gear is maintained when the one block portion is moved relative to the other block portion, wherein the output and crank shaft side gears are constituted to be able to slide relative to each other in the direction of the movement of the one block portion relative to the other block portion such that the meshing between the output and crank shaft side gears is maintained when the one block portion is moved relative to the other block portion, and wherein the crank shaft side gear is a spur gear.

12. The variable compression ratio internal engine as set forth in claim 11, wherein the rotation transmission shaft is supported on the block portions by a support member/support members at the position near the cam shaft side gear as possible.

13. The variable compression ratio internal engine as set forth in claim 11, wherein the rotation transmission shaft is constituted by at least two shaft portions, and the shaft portions are connected to be able to slide relative to each other in the direction of the movement of the one block portion relative to the other block portion such that the meshing between the input and cam shaft side gears or the meshing between the output and crank shaft side gears is maintained when the one block portion is moved relative to the other block portion.

14. The variable compression ratio internal engine as set forth in claim 13, wherein the shaft portions are telescopically overlapped and the telescopically overlapping parts are supported by a ball spline so as to be able to slide relative to each other.

15. The variable compression ratio internal engine as set forth in claim 13, wherein the rotation transmission shaft is supported on the block portions by a support member/support members at the position near the cam shaft side or crank shaft side gear as possible.

16. A variable compression ratio internal engine constituted by at least two block portions connected to each other so as to be able to move relative to each other and constituted such that the mechanical compression ratio in the combustion chamber can be varied by moving one of the block portions relative to the other block portion, comprising:

a cam shaft having a cam for driving an intake or exhaust valve positioned on one of the block portions;

a crank shaft positioned on the other block portion;

an output gear for outputting the rotation of the crank shaft; and an input gear for inputting the rotation output from the output gear to the cam shaft;

the engine being constituted such that the input gear moves relative to the output gear along with the movement of the one block portion when the one block portion is moved relative to the other block portion, wherein the engine further comprises a rotation transmission shaft for transmitting the rotation output from the output gear to the input gear, wherein the rotation transmission shaft has a crank shaft side gear meshed with the output gear on one end thereof and a cam shaft side gear meshed with the input gear on the other end thereof, wherein the output gear and the crank shaft side gear are meshed with each other such that the rotation transmission shaft is rotated around the axis thereof by the rotation of the crank shaft and the cam shaft side gear and the input gear are meshed with each other such that the cam shaft is rotated around the axis thereof by the rotation of the rotation transmission shaft, and wherein the input gear and the rotation transmission shaft are constituted to be able to slide relative to each other or the output gear and the rotation transmission shaft are constituted to be able to slide relative to each other in the direction of the movement of the one block portion relative to the other block portion such that the meshing between the input gear and the cam shaft side gear or the meshing between the output gear and the crank shaft side gear is maintained when the one block portion is moved relative to the other block portion, wherein the output and crank shaft side gears are constituted to be able to slide relative to each other in the direction of the movement of the one block portion relative to the other block portion such that the meshing between the output and crank shaft side gears is maintained when the one block portion is moved relative to the other block portion, and wherein at least one of the output and crank shaft side gears is biased against the other thereof such that the output and crank shaft side gears are pressed toward each other.

17. The variable compression ratio internal engine as set forth in claim 16, wherein the rotation transmission shaft is supported on the block portions by a support member/support members at the position near the cam shaft side gear as possible.

18. The variable compression ratio internal engine as set forth in claim 16, wherein the rotation transmission shaft is constituted by at least two shaft portions, and the shaft portions are connected to be able to slide relative to each other in the direction of the movement of the one block portion relative to the other block portion such that the meshing between the input and cam shaft side gears or the meshing between the output and crank shaft side gears is maintained when the one block portion is moved relative to the other block portion.

19. The variable compression ratio internal engine as set forth in claim 18, wherein the shaft portions are telescopically overlapped and the telescopically overlapping parts are supported by a ball spline so as to be able to slide relative to each other.

20. The variable compression ratio internal engine as set forth in claim 18, wherein the rotation transmission shaft is supported on the block portions by a support member/support members at the position near the cam shaft side or crank shaft side gear as possible.

* * * * *